US007314560B2

(12) United States Patent
Yoshida et al.

(10) Patent No.: US 7,314,560 B2
(45) Date of Patent: Jan. 1, 2008

(54) CYCLONE SEPARATOR

(76) Inventors: Hideto Yoshida, c/o Hiroshima University 4 - 1, Kagamiyama 1 - chome, Higashi Hiroshima - shi, Hiroshima (JP); Kunihiro Fukui, Room Number301, Ko - po N Plaza, 7 - 7, Saijou - cho Shitami 6 - chome, Higashi Hiroshima - shi, Hiroshima (JP); Kazuaki Takahashi, c/o Takahashi Co., LTD., 1312 - 8, Ooaza busshi, Iruma - shi, Saitama (JP); Junichi Nakamura, c/o Takahashi Co., LTD., 1312 - 8, Ooaza busshi, Iruma - shi, Saitama (JP)

( * ) Notice: Subject to any disclaimer, the term of this patent is extended or adjusted under 35 U.S.C. 154(b) by 392 days.

(21) Appl. No.: 10/821,163

(22) Filed: Apr. 8, 2004

(65) Prior Publication Data

US 2005/0077234 A1 Apr. 14, 2005

(30) Foreign Application Priority Data

Oct. 10, 2003 (JP) ..... 2003-352810
Feb. 18, 2004 (JP) ..... 2004-040911
Feb. 18, 2004 (JP) ..... 2004-041132

(51) Int. Cl.
*B01D 21/26* (2006.01)

(52) U.S. Cl. ..... 210/512.2; 210/512.1; 209/727; 209/728; 209/734

(58) Field of Classification Search ..... 210/512.1, 210/512.2; 209/711, 715, 717, 719, 727, 209/728, 734; 55/459.1, 459.4
See application file for complete search history.

(56) References Cited

U.S. PATENT DOCUMENTS 6,426,010 B1 * 7/2002 Lecoffre et al. ..... 210/512.1
6,669,843 B2 * 12/2003 Arnaud ..... 210/221.2

FOREIGN PATENT DOCUMENTS

| | | |
|---|---|---|
| JP | 10-286493 | 10/1998 |
| JP | 2000-288425 | 10/2000 |
| JP | 2001-137743 | 5/2001 |
| WO | WO03/045569 A1 | 6/2003 |

* cited by examiner

*Primary Examiner*—David A Reifsnyder
(74) *Attorney, Agent, or Firm*—Flynn, Thiel, Boutell & Tanis, P.C.

(57) ABSTRACT

The present invention provides a cyclone separator made up of a cyclone portion for generating an eddy flow at a given flow rate by feeding a liquid containing a fine substance from liquid discharge passageways, for transferring the fine substance to an outer circumferential side by applying a centrifugal force to discharge the fine substance-free liquid from a liquid flow-out passageway, and for precipitating the fine substance by decelerating the eddy flow. The liquid discharge passageways are disposed at plural sites and the cyclone separator further contains a liquid pressurizing chamber formed around the plural liquid discharge passageways in communication therewith, and a liquid introduction passageway for introducing the liquid containing the fine substance into the liquid pressurizing chamber.

14 Claims, 26 Drawing Sheets

CYCLONE SEPARATOR

BACKGROUND OF THE INVENTION

1. Field of the Invention

The present invention relates to a cyclone separator for removing a fine substance such as a fine powder produced as waste during a machining process.

2. Description of the Related Art

Machining processes are carried out by feeding a cutting liquid from a feed tank in a machining apparatus, and the used cutting liquid contains a fine powder as machining waste. The cutting liquid containing the fine powder as the machining waste is supplied to a filter device, and the cutting liquid devoid of the machining waste after filtering is recycled to the feed tank (for example, Japanese Unexamined Patent Application Publication No. 2001-137743).

While the machining waste is removed, for example, with a filter membrane of the filter device, or the machining waste is removed by precipitation, there is a problem in that a large amount of the machining waste contained in the cutting liquid cannot be reliably removed within a short period of time using a small device. The filter membrane may become clogged, and the clogged filter membrane needs to be cleaned after disassembling the filter device. The filter membrane needs to be exchanged when it is disabled even after cleaning. Since the filtration accuracy deteriorates and the filter membrane becomes readily clogged by repeated use, most of the filter membranes are in the form of disposable membranes. Accordingly, the filter cost becomes expensive.

The problem of clogging may be solved by using a cyclone separator in place of such a filter device, since the liquid containing the fine substance is introduced from a liquid flow-in passageway to generate an eddy flow at a given flow rate, the fine substance is transferred toward an outer circumferential side by applying a centrifugal force to discharge a fluid after separating the fine substance, and the separated substance is precipitated by decelerating the eddy flow (for example, Japanese Unexamined Patent Application Publication No. 10-286493 and 2000-288425).

Since the cyclone separator has one liquid flow-in passageway, the liquid flow-in passageway should be narrowed to increase the flow rate of the eddy flow. However, the pressure loss increases by narrowing the liquid flow-in passageway making it difficult to obtain an appropriate flow rate during processing.

In addition, forming the eddy flow from one liquid flow-in passageway generates a turbulence in the eddy flow, and a satisfactory separation accuracy cannot be obtained since particles cannot be easily separated into particles having accurate particle diameters.

While a high processing flow rate may be obtained by providing a plurality of liquid flow-in passageways for feeding the liquid, the cyclone separator necessarily becomes larger as a result of the plural pipe lines, making it difficult to provide an installation area.

SUMMARY OF THE INVENTION

Accordingly, it is an object of the present invention for solving the problems above to provide a cyclone separator that is able to ensure a required flow rate using a small size-system, to improve the separation accuracy by separating particles into particles having an accurate particle diameter, and to permit the flow rate and particle diameter of the separated particles to be variable by a simple method.

The present invention for solving the above problems and for attaining the object of the present invention provides the following constructions.

In a first aspect, the present invention provides a cyclone separator comprising a cyclone portion for generating an eddy flow at a given flow rate by feeding a liquid containing a fine substance from the liquid discharge passageways, for transferring the fine substance to an outer circumferential side by applying a centrifugal force to discharge the fine substance-free liquid from a liquid flow-out passageway, and for precipitating the fine substance by decelerating the eddy flow. The liquid discharge passageways are disposed at plural sites. The cyclone separator further comprises a liquid pressurizing chamber formed around the plural liquid discharge passageways in communication therewith, and a liquid introduction passageway for introducing the liquid containing the fine substance into the liquid pressurizing chamber.

The liquid containing the fine substance is introduced from the liquid flow-in passageway into the pressurizing chamber, and the liquid containing the fine substance is supplied to the cyclone portion through a plurality of liquid discharge passageways from the liquid pressurizing chamber to generate the eddy flow at a given rate. The processing flow rate can be increased by providing liquid discharge passageways at plural sites. The liquid supply pressure from the plural liquid discharge passageways is made to be uniform by providing the liquid pressurizing chamber such that it can afford a rectified liquid containing the fine substance with no turbulent flow in the eddy flow. Consequently, the flow rate is increased to enable the fine particles to be separated into particles having an accurate particle diameter with an increased accuracy of separation. The processing flow rate from the pipe-line connected to one liquid flow-in passageway may be increased by providing the pressurizing chamber without providing plural pipelines, and the system can be compacted to enable installation in a small area.

In a second aspect, the present invention provides a cyclone separator comprising a plurality of cyclone portions disposed in parallel. Each cyclone portion generates an eddy flow at a given flow rate by feeding a liquid containing a fine substance from liquid discharge passageways, transferring the fine substance to an outer circumferential side by applying a centrifugal force to discharge the fine substance-free liquid from a liquid flow-out passageway, and precipitating the fine substance by decelerating the eddy flow. A plurality of the liquid discharge passageways are disposed at each cyclone portion. The cyclone portion further comprises a liquid pressurizing chamber formed in communication with the plural liquid discharge passageways, a liquid introduction passageway for introducing the liquid containing the fine substance into the liquid pressurizing chamber, and an external discharge part for discharging the liquid by joining the liquid discharge passageways at respective cyclone portions.

The construction in the second aspect of the present invention permits the processing flow rate to be increased by increasing the number of cyclone portions. The same effect as in the first aspect of the present invention is also exhibited in the second aspect of the present invention, and the system can be made even more compact by disposing the plural cyclone portions in parallel to enable installation in a small area.

Preferably, the cyclone separator according to the present invention comprises an introduction pipe having liquid introduction passageways for introducing the liquid containing the pulverized fine substance, and an orifice ring disposed within the introduction pipe and having liquid discharge passageways formed at plural sites. The pressurizing chamber communicating with the liquid discharge passageway is formed between the introduction pipe and orifice ring. Disposing the orifice ring having the plural liquid discharge passageways within the introduction pipe permits the pressurizing chamber communicating with the liquid discharge passageways to be readily formed between the introduction pipe and the orifice ring.

The liquid discharge passageways may be disposed at symmetrical positions when viewed from the direction along the axis of the cyclone portion. Feeding the liquid from the plural symmetrical positions permits a rectified eddy flow of the liquid without turbulence, and the flow rate is increased to enable the fine particles to be separated into particles having an accurate particle diameter with an increased accuracy of separation.

The liquid discharge passageways may be disposed at an equal distance apart from one another. This construction also affords the same effect as described above.

Preferably, the liquid discharge passageways permit the liquid to flow in a tangential direction of the inner wall of the orifice ring. Feeding the liquid in the tangential direction permits a rectified eddy flow of the liquid without turbulence along the inner wall of the orifice ring, and the flow rate is increased to enable the fine particles to be separated into particles having an accurate particle diameter with an increased accuracy of separation.

The liquid flow passageways may be formed so as to be displaced in the tangential direction toward the inside of the inner wall of the orifice ring. Feeding the liquid as described above can eliminate turbulence of the eddy flow by reducing frictional resistance on the inner wall. The precipitation rate of the fine substance does not decrease, thereby enabling the expected separation productivity and separation performance to be obtained.

Preferably, the liquid flow passageways are displaced 0.5 to 1.5 mm inside in the tangential direction of the inner wall of the orifice ring. Feeding the liquid as described above can reduce frictional resistance between the liquid and the inner wall, and an eddy flow without large turbulence may be obtained.

The liquid discharge passageways may be formed into a curved shape. The feed liquid flows along a curved line, and a rectified eddy flow without turbulence may be formed along the inner wall of the orifice ring. Consequently, the flow rate increases to enable the fine particles to be classified into particles having an accurate particle diameter with an increased accuracy of separation.

Preferably, the orifice ring comprises an inner ring having an outlet side liquid discharge passageway and an outer ring having an inlet side liquid passageway, and the liquid flow-in rate of the liquid discharge passageway is varied by a sliding movement between the inner ring and outer ring in a circumference direction. This construction permits the particle diameter of the separated particles to be readily varied.

Preferably, the liquid discharge passageway has a larger cross-sectional area at the inlet side than the cross-sectional area at the outlet side. This also permits the flow rate from the liquid discharge passageway to be increased to enable the fine particles to be separated into particles having an accurate particle diameter with an increased accuracy of separation.

Preferably, the liquid discharge passageway has a linear passageway surface parallel to the tangent of the inner wall of the orifice ring, and a convex passageway surface at the linear passage surface side. The flow rate is increased by providing the linear passageway surface and curved convex passageway surface, thereby enabling the expected separation productivity and separation performance to be obtained.

The orifice ring may be exchangeable with another orifice ring having a different liquid discharge passageway. This enables the particle diameter of the separated particles to be readily varied.

The present invention also provides a cyclone separator comprising a liquid flow-in part having the liquid discharge passageway formed to upwardly open at the upper part in the vertical direction of the cyclone portion, and a cover having the liquid flow-out passageway to close the opening of the liquid flow-in part. The orifice ring may be supported between the liquid flow-in part and the cover to be attachable and detachable. The construction described above permits the pressurizing chamber communicating with the liquid discharge passageway to be readily formed.

Preferably, the external discharge part is disposed on a line different from the extended line of the liquid introduction passageway. This construction permits the cyclone separator to be installed without changing the pipe directions when the pipe direction of the external discharge portion is different from the pipe direction of the liquid introduction passageway.

The external discharge part may be disposed on the extended line of the liquid introduction passageway. This construction permits the cyclone separator to be installed without changing the pipe directions when the pipe direction of the external discharge portion is the same as the piping direction of the liquid introduction passageway.

DESCRIPTION OF THE PREFERRED EMBODIMENTS

While embodiments of the fine particle separation treatment system of the present invention are described hereinafter, the present invention is not restricted to these embodiments. While the embodiments of the present invention show the best mode for carrying out the present invention, the terms in the present invention are not restricted thereto.

The cyclone separator of this embodiment is used for the filtration of fine substances in materials used in the pharmaceutical, chemical, food and drink industries, for retrieving cutting refuse in automobile, machine and machining industries, for filtration of recycling and drain water in factories and water processing plants, and for removing fine substances, such as impurities in semiconductor and bio industries, as well as for removing fine particles as foreign substances in cleaning water and solvents. The cyclone separator is widely used for the separation and removal of fine particles contained in liquids.

Figure 1:
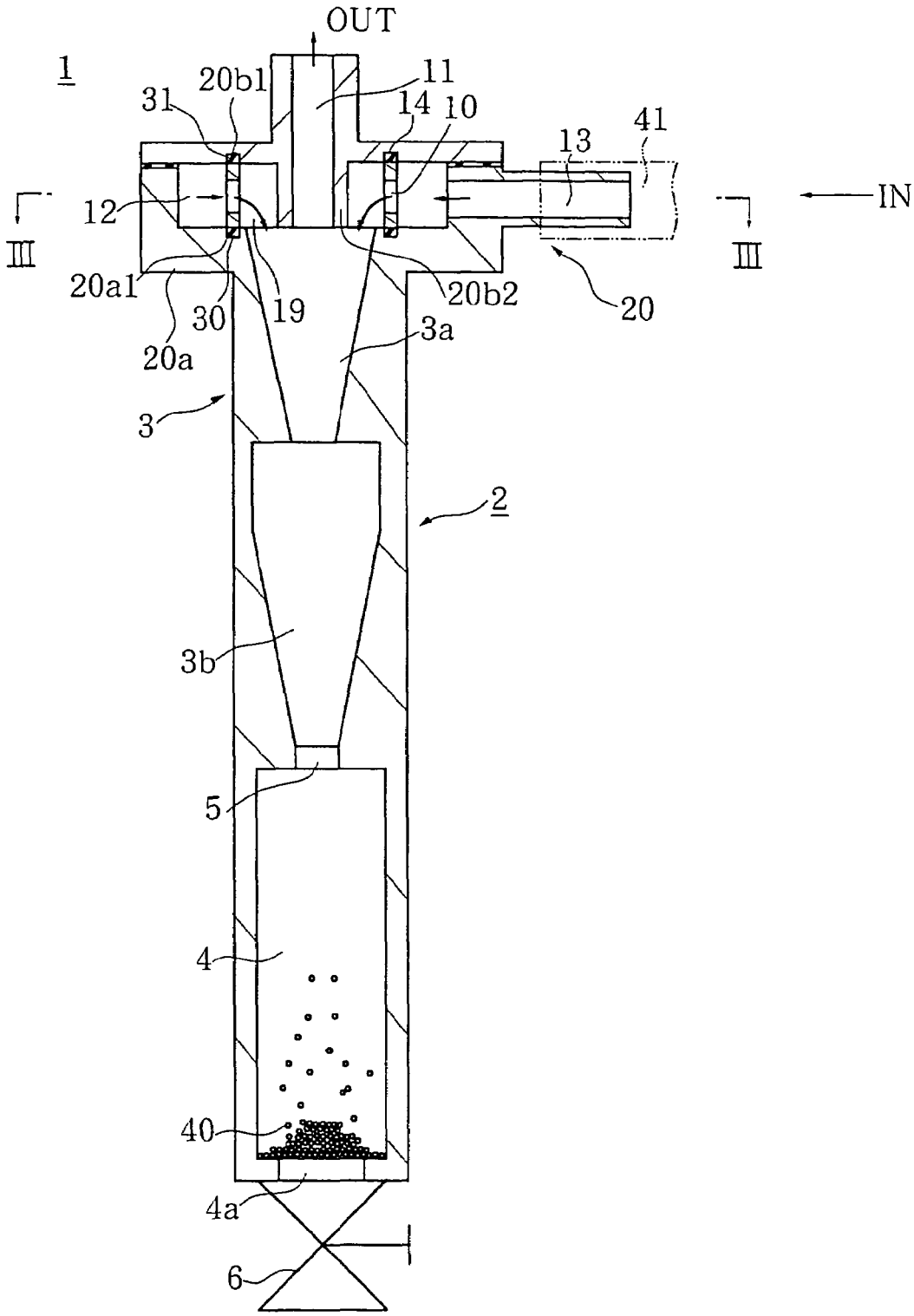
FIG. 1 is a cross-section of a cyclone separator.
Figure 2:
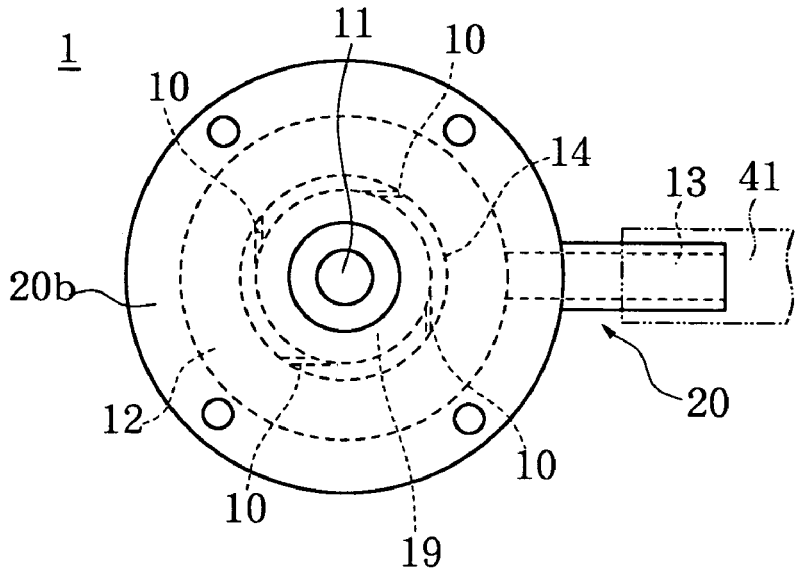
FIG. 2 is a plan view of the cyclone separator.
Figure 3:
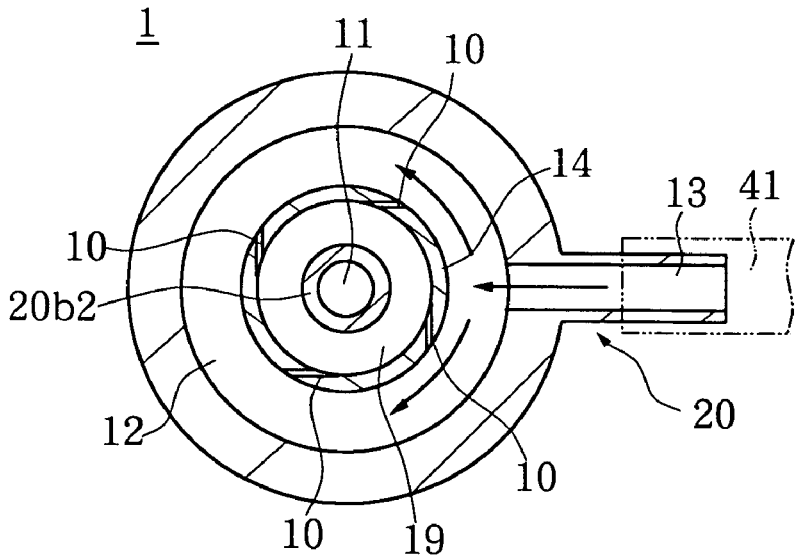
FIG. 3 is a cross-section along the line III-III in FIG. 1.

An example of the cyclone separator in this embodiment is shown in FIGS. 1 to 3. FIG. 1 shows a cross-section and FIG. 2 shows a plan view of the cyclone separator, and FIG. 3 shows a cross-section along the line III-III in FIG. 1.

The cyclone separator used for retrieving fine substances, such as powders from cutting in the machine and machining industries, will be described in this embodiment. While removal of fine substances, such as powders from cuttings contained in a liquid, is described in this embodiment, any fine substances may be retrieved, and this embodiment is not restricted to fine powder refuse.

The cyclone separator 1 in this embodiment comprises a cyclone portion 3 and particle trap part 4 in the vertical direction of a hermetic cylinder 2. The hermetic cylinder 2 is made of a metal such as SUS and aluminum, and is excellent in mechanical strength.

The cyclone portion 3 comprises two stages of tapered portions 3*a* and 3*b*, with the lower tapered portion 3*b* communicating with the particle trap part 4 through a communication hole 5. A liquid containing the fine substance is supplied from a liquid discharge passageway 10 to generate an eddy flow at a given flow rate in the cyclone portion 3. The fine substance is transferred to the cyclone portion outer circumference by applying a centrifugal force, the liquid devoid of the fine substance is removed from a liquid flow-out passageway 11, and the separated fine substance is precipitated by decelerating the eddy flow.

The separated fine substance precipitating in the cyclone portion 3 falls down into the particle trap portion 4 through the communication hole 5 to accumulate there. A drain valve 6 is connected to a discharge hole 4*a* at the bottom of the particle trap portion 4, and the fine substance that has accumulated in the particle trap portion 4 is drained through the drain valve 6.

A plurality of liquid discharge passageways 10 are disposed in the cyclone separator 1 in this embodiment, and liquid pressurizing chambers 12 and liquid introduction passageways 13 for introducing the liquid containing the fine substance into the liquid pressurizing chambers 12 are formed around the plural liquid discharge passageways 10 in communication therewith. The plural liquid discharge passageways 10 are formed as orifice rings 14, and each orifice ring 14 is placed within an introduction pipe 20 having the liquid introduction passageway 13 for introducing the liquid containing the fine substance. Each liquid pressurizing chamber 12 communicating with each liquid discharge passageway 10 is formed between the introduction pipe 20 and orifice ring 14.

The introduction pipe 20 is formed at the upper part in the vertical direction of the cyclone portion 3 so as to be upwardly open, and comprises a liquid flow-in portion 20*a* having the liquid discharge passageway 10. The opening of the liquid flow-in portion 20*a* is blocked with a cover 20*b* having the liquid flow-out passageway 11, and the orifice ring 14 is supported so as to be attachable and detachable between the liquid flow-in portion 20*a* and the cover 20*b*. A packing 30 is fitted in an annular groove 20*a*1 of the liquid flow-in portion 20*a*, a packing 31 is fitted in an annular groove 21*b* of the cover 20*b*, and the orifice ring 14 is supported so as to be liquid-tight between the packing 30 and packing 31. The orifice ring 14 is exchangeable.

An introduction chamber 19 communicating with the upper tapered portion 3*a* of the cyclone portion 3 is formed between the orifice ring 14 and a cylinder portion 20*b*2 for forming the liquid flow-out passageway 11 of the cover 20*b*. A cutting liquid, as a fluid from the plural liquid discharge passageways 10, is supplied to the introduction chamber 19, and flows into the upper tapered portion 3*a* as an eddy flow.

The cyclone separator 1 in this embodiment is disposed, for example, in a system for performing cutting work, by feeding the cutting liquid as a fluid, the cutting liquid that contains fine powder of cutting refuse as the fine substance is supplied to the cyclone separator 1, and the cutting liquid, after removing the cutting refuse with the cyclone separator 1 is recycled to the feed tank.

The cutting liquid is introduced into the liquid pressurizing chamber 12 from the liquid introduction passageway 13 of the cyclone separator 1, and supplied to the upper tapered portion 3*a* of the cyclone portion 3 from the liquid pressurizing chamber 12 through the plural liquid discharge passageways 10 to generate an eddy flow at a given flow rate. A centrifugal force is applied by generating an eddy flow at a given flow rate from the upper tapered portion 3*a* to the lower tapered portion 3*b*, and the fine substance is transferred to the outer circumferential side by the action of the centrifugal force, while clean liquid, after removing the fine substance, flows up from the axis of the cyclone portion in the direction of the liquid flow-out passageway 11. The fine substance precipitates and sequentially enters into the particle trap portion 4 at the lower side by being guided with the communication hole 5, and the fine substance 40 is precipitated in the particle trap portion 4.

The processing flow rate can be increased by increasing the number of liquid discharge passageways 10 in the cyclone separator 1 in this embodiment. Providing the liquid pressurizing chamber 12 permits the feed pressure at the plural liquid discharge passageways 10 to be uniform and allow a rectified eddy flow without turbulence to be obtained. Consequently, the fine particles are separated into particles having an accurate particle diameter with an increased accuracy of separation. Providing the pressurizing chamber 12 also enables the processing flow rate to be increased from a pipeline 41 connected to one liquid introduction passageway 13. Accordingly, a plurality of pipes are not needed, and the system becomes small enough to enable installation.

Providing the orifice ring 14 having the plural liquid discharge passageways 10 within the introduction pipe 20 permits each pressurizing chamber 12 communicating with each liquid discharge passageway 10 to be readily formed between the introduction pipe 20 and orifice ring 14.

Figure 4:
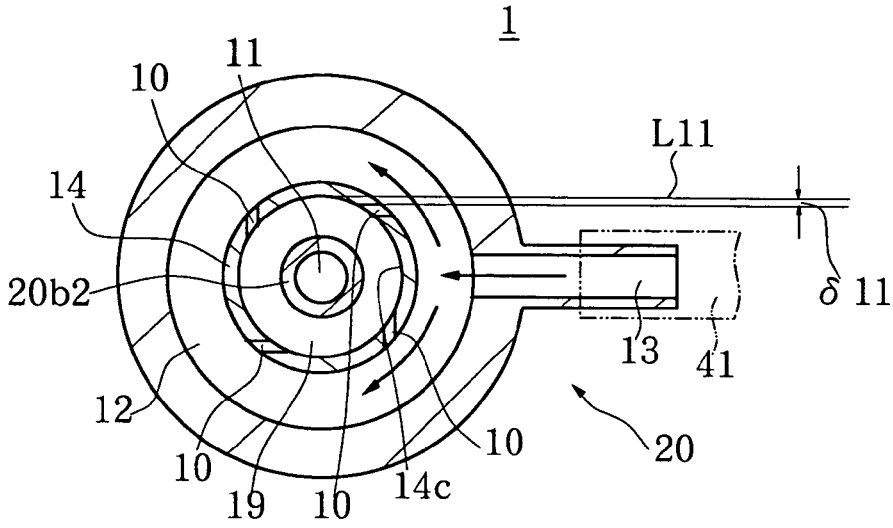
FIG. 4 shows another embodiment of the liquid discharge passageway.

Another embodiment of the liquid discharge passageway 10 is shown in FIG. 4. Four liquid discharge passageways 10 are slightly displaced in a tangential direction L11 of the inner wall 14*c* of the orifice ring 14 to the inside with a distance δ11, and are formed in directions 90° different to each other. Forming the liquid discharge passageways 10 so as to be slightly displaced in a tangential direction L11 of the inner wall 14*c* of the orifice ring 14 permits the liquid containing the fine substance supplied from the liquid introduction passageway 10 to the pressurizing chamber 12 to be supplied to the cyclone portion 3 from the liquid introduction passageway 10. Turbulence of the eddy flow is eliminated by reducing the frictional resistance on the inner wall 14*c* when the eddy flow revolves along the inner circumferential wall of the cyclone portion 3 to prevent the precipitation rate of the fine substance from decreasing in the liquid. Accordingly, a desired separation productivity and separation performance may be obtained.

The liquid discharge passageway 10 is displaced in the tangential direction L11 of the inner wall 14*c* of the orifice ring 14 with a distance δ11 of 0.5 to 2 mm inside. The frictional resistance cannot be reduced when the liquid discharge passageway 10 is too close in the tangential direction L11 of the inner wall 14*c* of the orifice ring 14, while a large eddy flow cannot be obtained when the distance is too large. However, the frictional resistance on the inner wall 14*c* of the orifice ring 14 may be reduced by displacing the liquid discharge passageway 10 in the tangential direction L11 of the inner wall 14*c* of the orifice ring 14 with a distance δ11 of 0.5 to 1.5 mm inside, and an eddy flow having a small turbulence is obtained along the inner wall.

Figure 5:
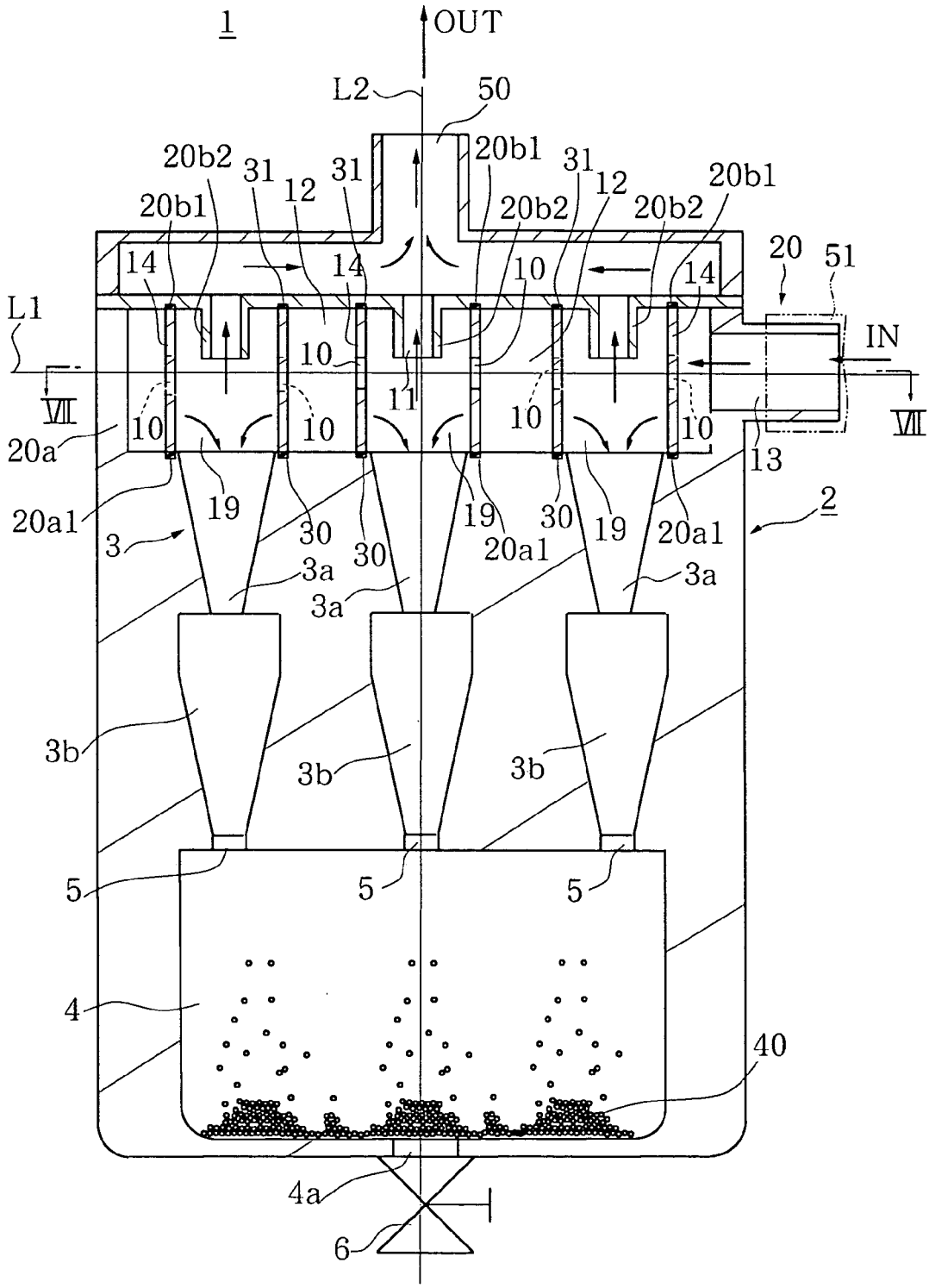
FIG. 5 is a cross-section of another cyclone separator.
Figure 6:
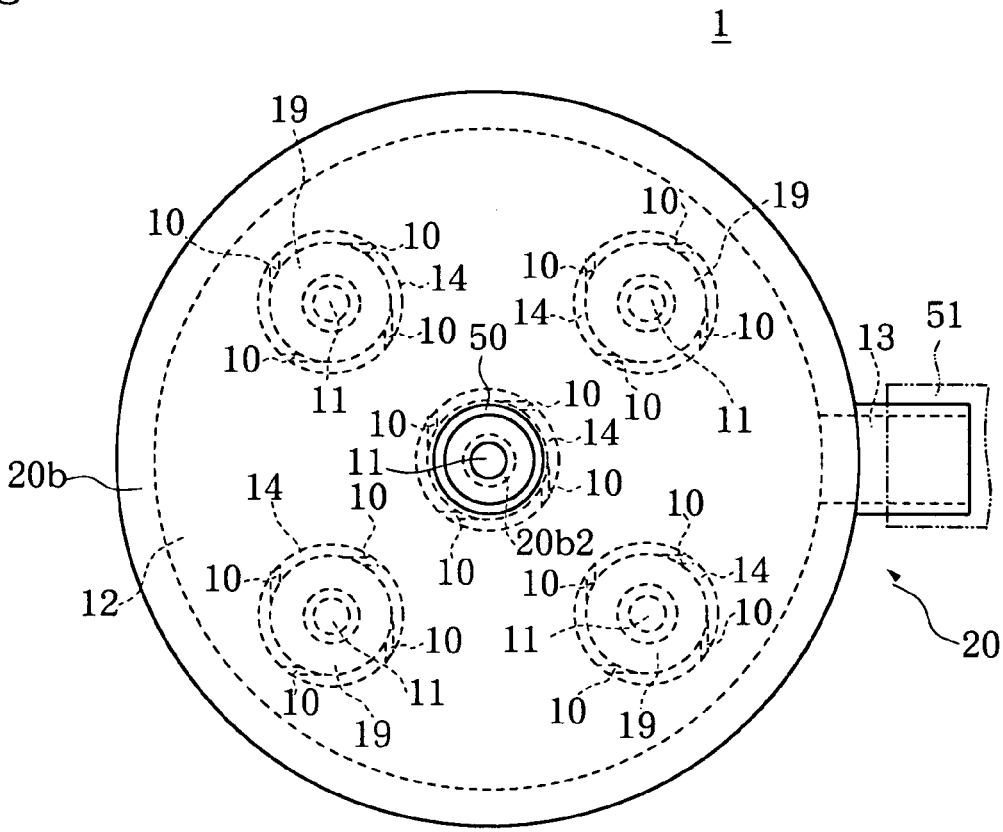
FIG. 6 is a plan view of the cyclone separator.
Figure 7:
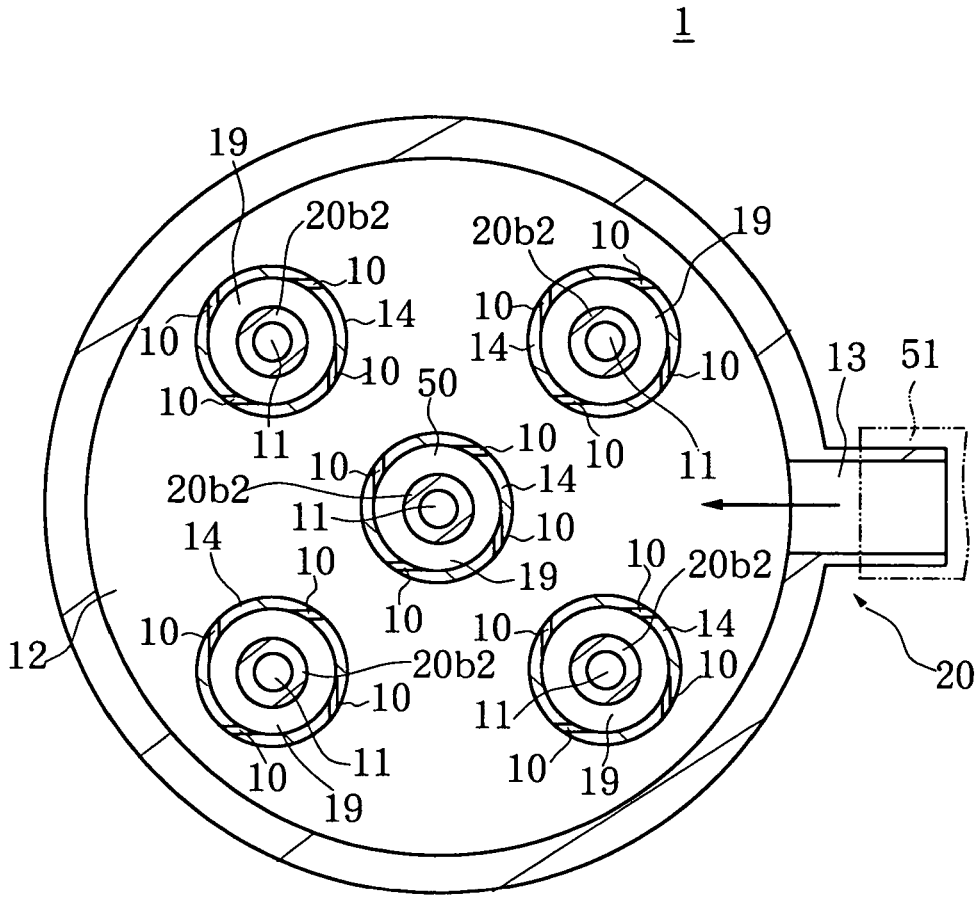
FIG. 7 is a cross-section along the line VII-VII in FIG. 5.

A different embodiment of the cyclone separator is shown in FIGS. 5 to 7. FIG. 5 is a cross-section and FIG. 6 is a plan view of the cyclone separator, and FIG. 7 shows a cross-section along the line VII-VII in FIG. 5.

A plurality of cyclone portions 3 constructed as in the embodiment in FIGS. 1 to 3 are disposed in parallel in the cyclone separator 1 of this embodiment. The same constituent elements as in FIGS. 1 to 3 are given the same reference numerals, and descriptions thereof are omitted.

Five cyclone portions 3 are disposed in this embodiment. The eddy flow is generated in each cyclone portion 3 by feeding the liquid containing the fine substance from each liquid discharge passageway 10, the fine substance is transferred to the outer side by applying a centrifugal force to discharge a fine substance-free liquid from the liquid flow-out passageway 11, and the separated fine substance is precipitated by decelerating the eddy flow.

A plurality of liquid discharge passageways 10 are disposed in each cyclone portion 3, and a liquid pressurizing chamber 12 is formed in communication with the plural liquid discharge passageways 10. The liquid pressurizing chamber 12 is formed into an orifice ring 14, and a liquid introduction passageway 13 is formed in communication with each liquid discharge passageway 10. An external discharge portion 50 is formed by joining the liquid flow-out passageways 11 of each cyclone portion 3.

The processing flow rate may be increased by increasing the number of cyclone portions 3, wherein the plural cyclone portions 3 are disposed in parallel, the cutting liquid containing the fine substance is introduced into the liquid pressurizing chamber 12 from the liquid introduction passageway 13, and the liquid containing the fine substance is supplied from the pressurizing chamber 12 through the plural liquid discharge passageways 10 to generate an eddy flow at a given flow rate. The liquid pressurizing chamber 12 permits the feed pressure in the plural liquid discharge passageways 10 of each cyclone portion 3 to be uniform, and a rectified eddy flow of the liquid containing the fine substance may be obtained without turbulence. Consequently, the flow rate can be increased to enable the fine particles to be separated into particles having an accurate particle diameter with an increased accuracy of separation. Since the processing flow rate from the pipe 51 connected to one liquid introduction passageway 13 is increased by providing the liquid pressurizing chamber 12, a plurality of pipes 51 are not needed to enable the installation in a small area, even when disposing the plural cyclone portions 3 in parallel.

The external discharge portion 50 is disposed on a line L2 different from an extension line L1 of the liquid introduction passageway 13. Since the external discharge portion 50 is disposed on the line L2 perpendicular to the extension line L1 of the liquid introduction passageway 13, the cyclone separator 1 can be installed without changing the pipe direction when the cyclone separator 1 is placed at a corner of an apparatus or facilities with different pipe directions between the external discharge portion 50 and liquid introduction passageway 13.

Figure 8:
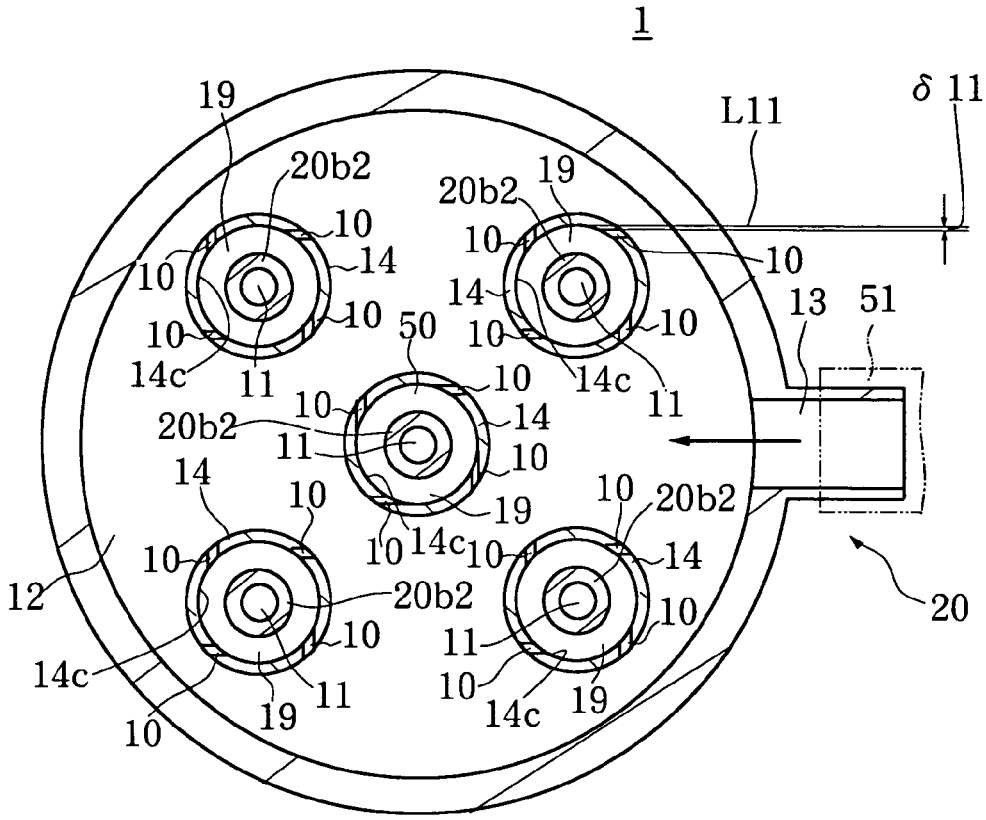
FIG. 8 shows a different embodiment of the liquid discharge passageway.

A different embodiment of the liquid discharge passageway 10 is shown in FIG. 8. The liquid discharge passageway 10 in this embodiment is constructed as in the embodiment of FIG. 4, and is formed by being displaced inside in the tangential direction L11 of the inner wall 14*c* of each orifice ring 14. The liquid discharge passageway 10 is displaced in the tangential direction of the inner wall 14*c* of each orifice ring 14 with a distance of 0.5 to 2 mm inside, and a plurality of the liquid discharge passageways 10 are symmetrically disposed with an equal distance apart from one another when viewed in the direction of the axis of the cyclone portion.

Figure 9:
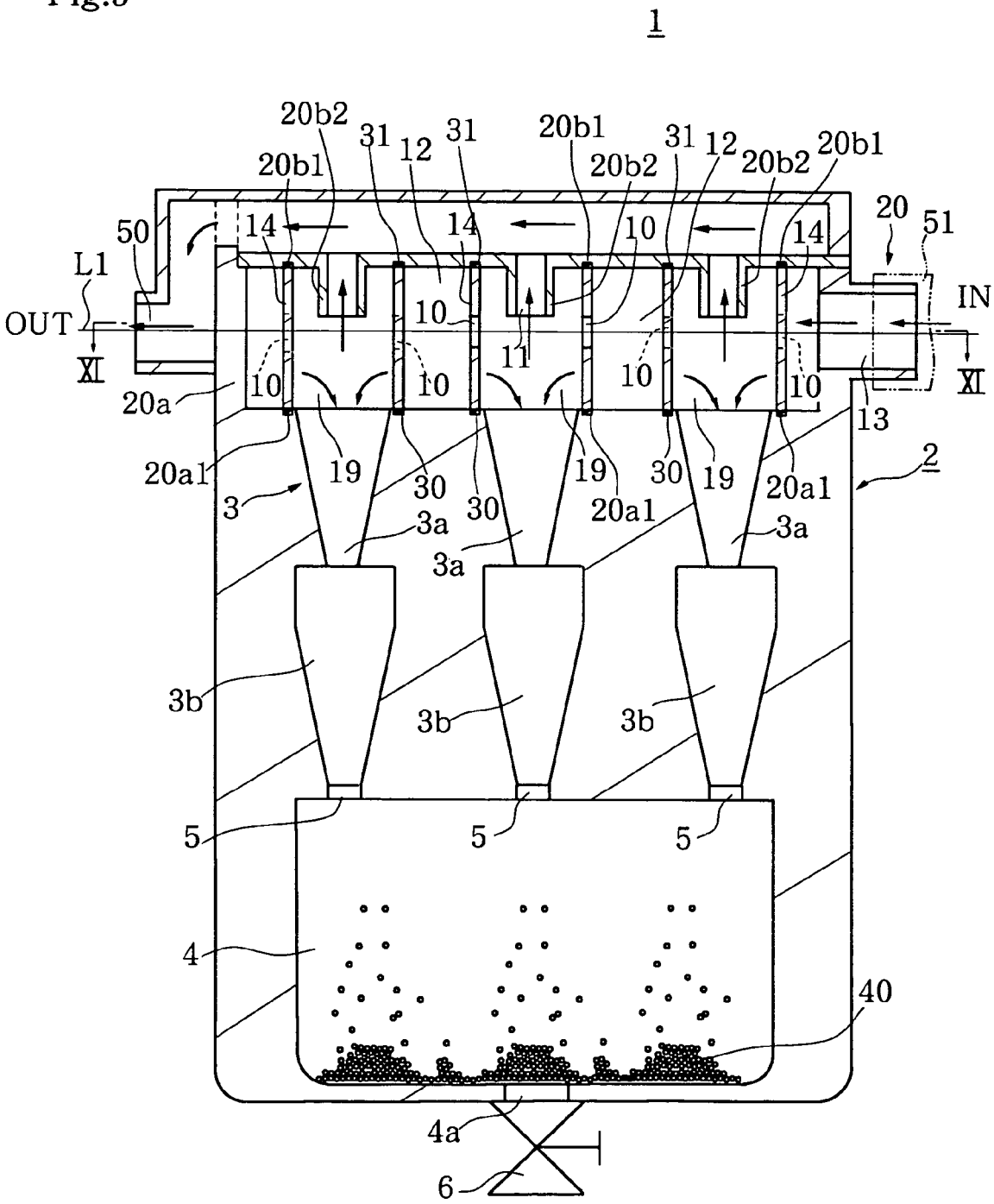
FIG. 9 is a cross-section of a different cyclone separator.
Figure 10:
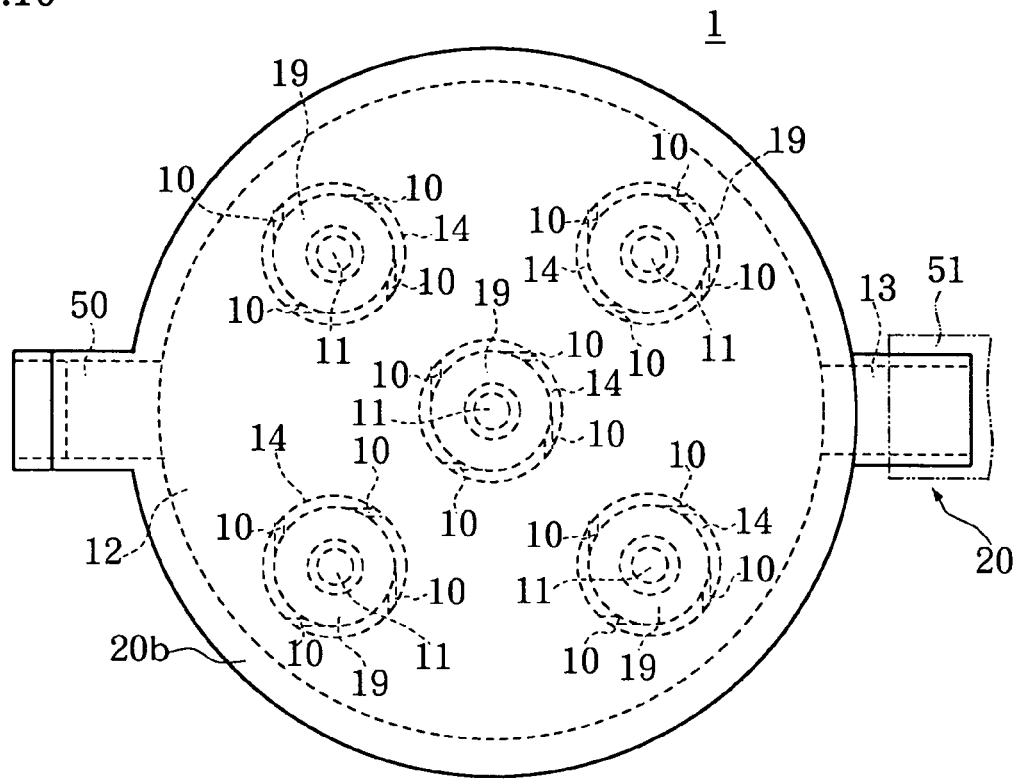
FIG. 10 is a plan view of the cyclone separator.
Figure 11:
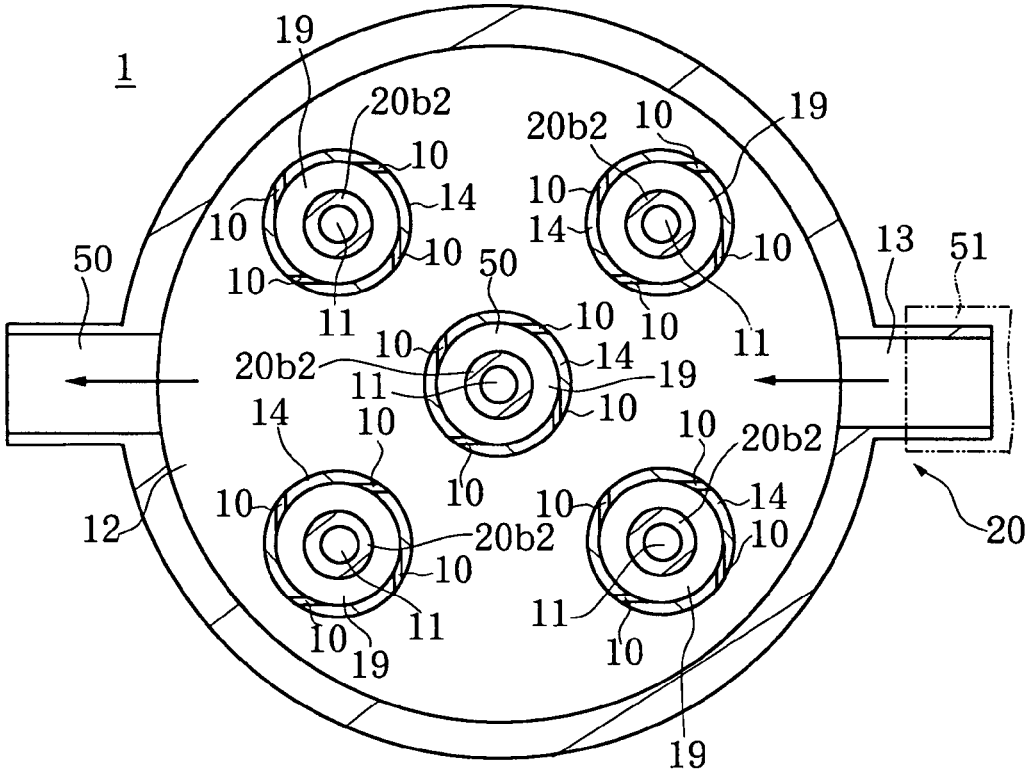
FIG. 11 is a cross-section along the line XI-XI in FIG. 9.

FIGS. 9 to 11 show a further different embodiment of the cyclone separator. FIG. 9 shows a cross-section and FIG. 10 shows a plan view of the cyclone separator, and FIG. 11 shows a cross-section along the line XI-XI in FIG. 9.

A plurality of cyclone portions 3 having the same construction as in the embodiment of FIGS. 1 to 3 are disposed in the cyclone separator in this embodiment. The same constituent elements as in FIGS. 1 to 3 are given the same reference numerals, and descriptions thereof are omitted.

While five cyclone portions 3 are disposed as in the embodiments shown in FIGS. 5 to 7, the external discharge portion 50 is placed on the extension line L1 of the liquid introduction passageway 13. Since the external discharge portion 50 is placed on the extension line L1 of the liquid introduction passageway 13, the cyclone separator 1 can be installed without changing the pipe direction even when the separator is placed on a linear line between the instruments, and when the pipe direction of the external discharge portion 50 is the same as the pipe direction of the liquid introduction passageway 13.

Figure 12:
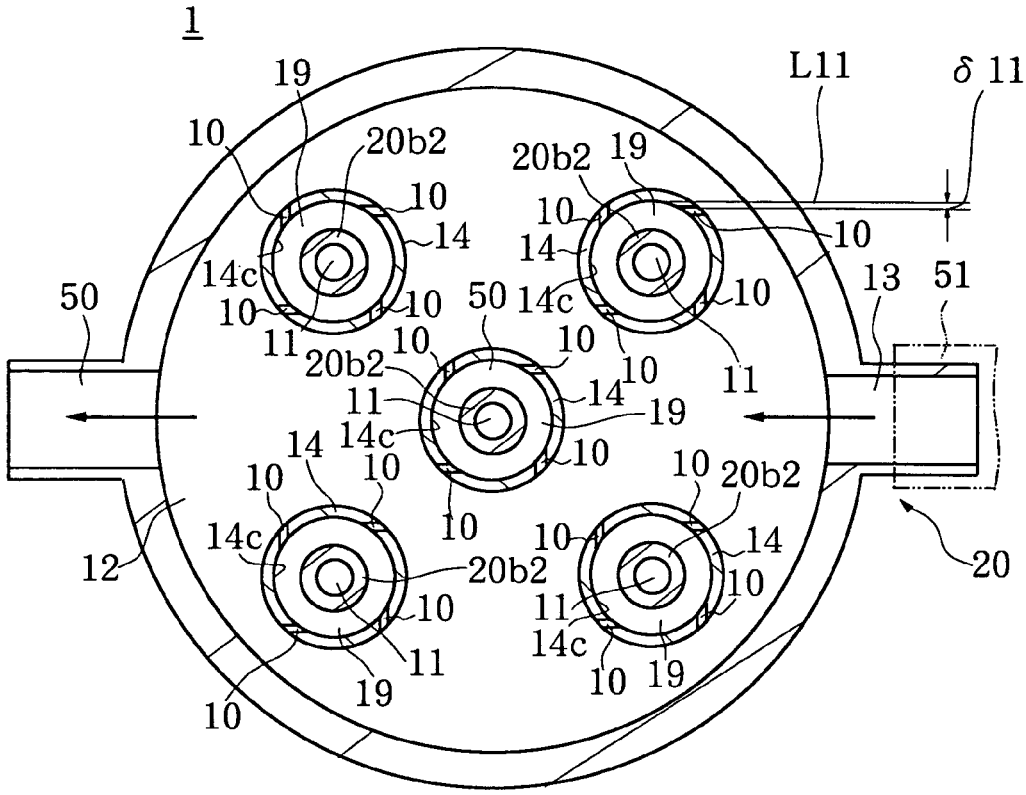
FIG. 12 shows a different embodiment of the liquid discharge passageway.

A further different embodiment of the liquid discharge passageway 10 is shown in FIG. 12. The liquid discharge passageway 10 in this embodiment is constructed as in the embodiment of FIG. 4, and is formed by being displaced inside in the tangential direction L11 of the inner wall 14*c* of each orifice ring 14. The liquid discharge passageway 10 is displaced 0.5 to 2 mm inside in the tangential direction of the inner wall 14*c* of each orifice ring 14, and a plurality of liquid discharge passageways 10 are disposed with an equal distance apart from one another when viewed in the axial direction of the cyclone portion.

The features of the orifice ring 14 shown in the embodiment of FIGS. 1 to 4, the embodiment of FIGS. 5 to 8, and the embodiment of FIGS. 9 to 12 in the cyclone separator are shown in FIGS. 13 to 20.

Figure 13:
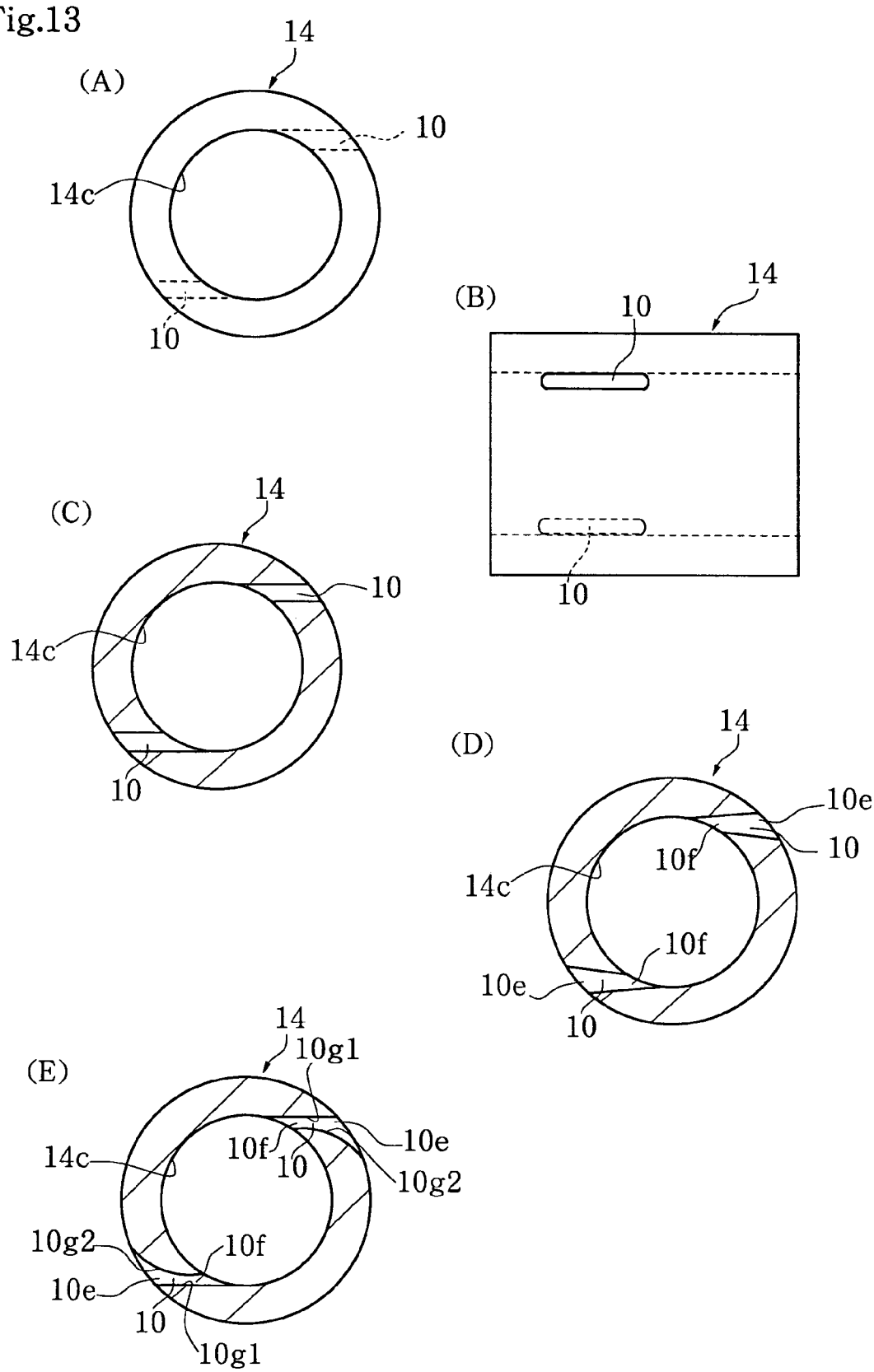
FIGS. 13A to 13E show the embodiments of the orifice ring.

Two liquid discharge passageways 10 are symmetrically disposed in the orifice ring 14 with an equal angular distance of 180° in the embodiment of FIG. 13 when viewed in the direction of the axis of the cyclone portion. The liquid discharge passageway 10 is formed straight so that the liquid is introduced in the tangential direction of the inner wall 14*c* of the orifice ring 14.

FIG. 13D shows another embodiment of the liquid discharge passageways 10. The cross-sectional area of the inlet side 10*e* of the liquid discharge passageways 10 is larger than the cross-sectional area of the outlet side 10*f*. The liquid gradually converges from the inlet side 10*e* in the direction of the outlet side 10*f* to increase the flow rate from the liquid discharge passageways 10 to enable the fine particles to be separated into particles having an accurate particle diameter with an increased accuracy of separation.

FIG. 13E shows a different embodiment of the liquid discharge passageway 10. While the liquid discharge passageway is constructed as in FIG. 13D, the passageway comprises a linear passageway surface 10*g*1 parallel to the tangent of the cross-section perpendicular to the axis of the cyclone portion, and a curved convex passageway surface 10*g*2 facing the linear passageway surface. The flow rate from the liquid discharge passageway 10 is increased by the linear passageway surface 10*g*1 and curved convex passageway surface 10*g*2 to enable the fine particles to be separated into particles having an accurate particle diameter with an increased accuracy of separation.

Figure 14:
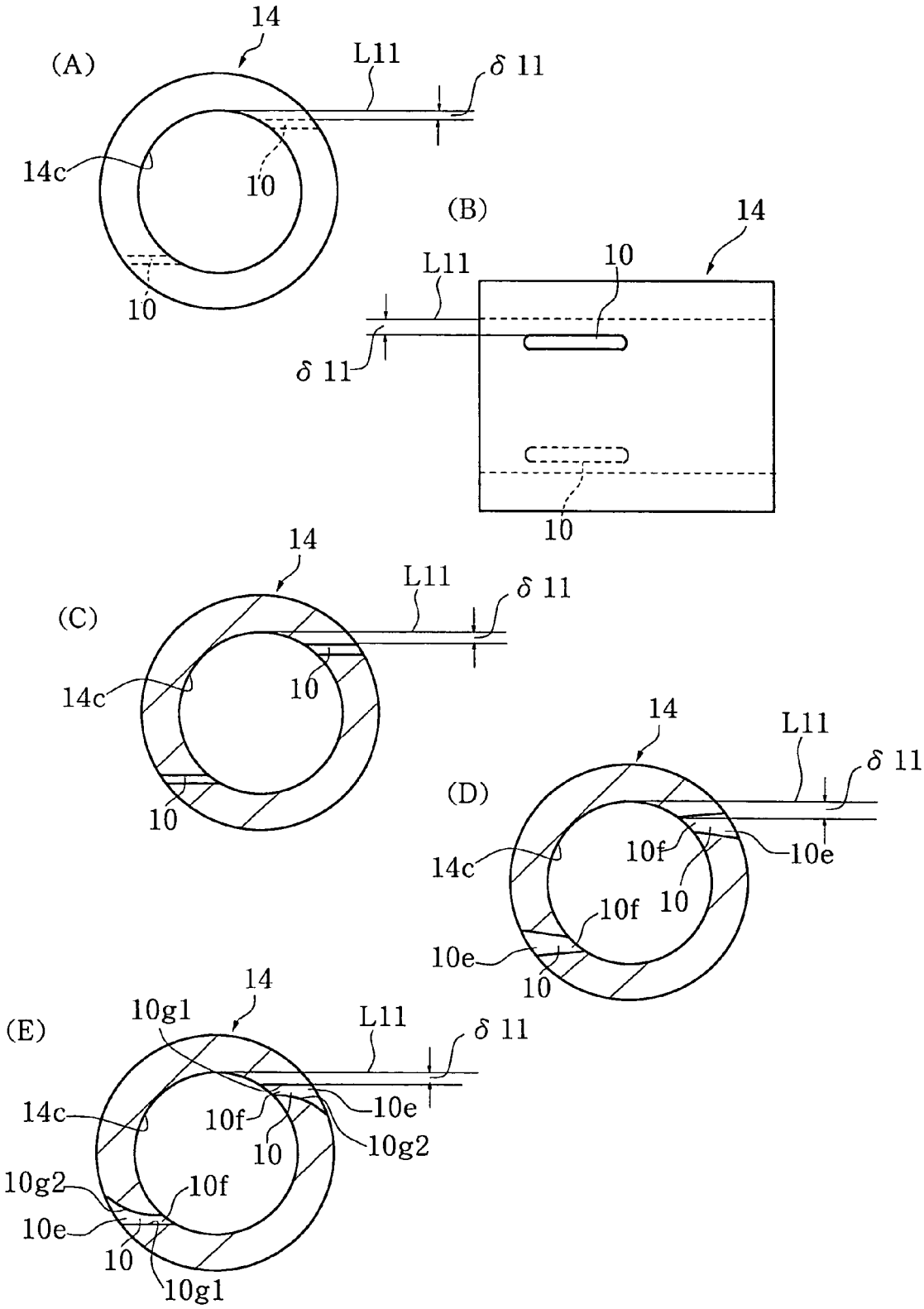
FIGS. 14A to 14E show different embodiments of the orifice ring.

While the orifice ring 14 in the embodiment in FIG. 14 is constructed as in the embodiment in FIG. 13, the liquid discharge passageway 10 is formed by being inwardly displaced in the tangential direction L11 of the inner wall 14*c* of the orifice ring 14.

Figure 15:
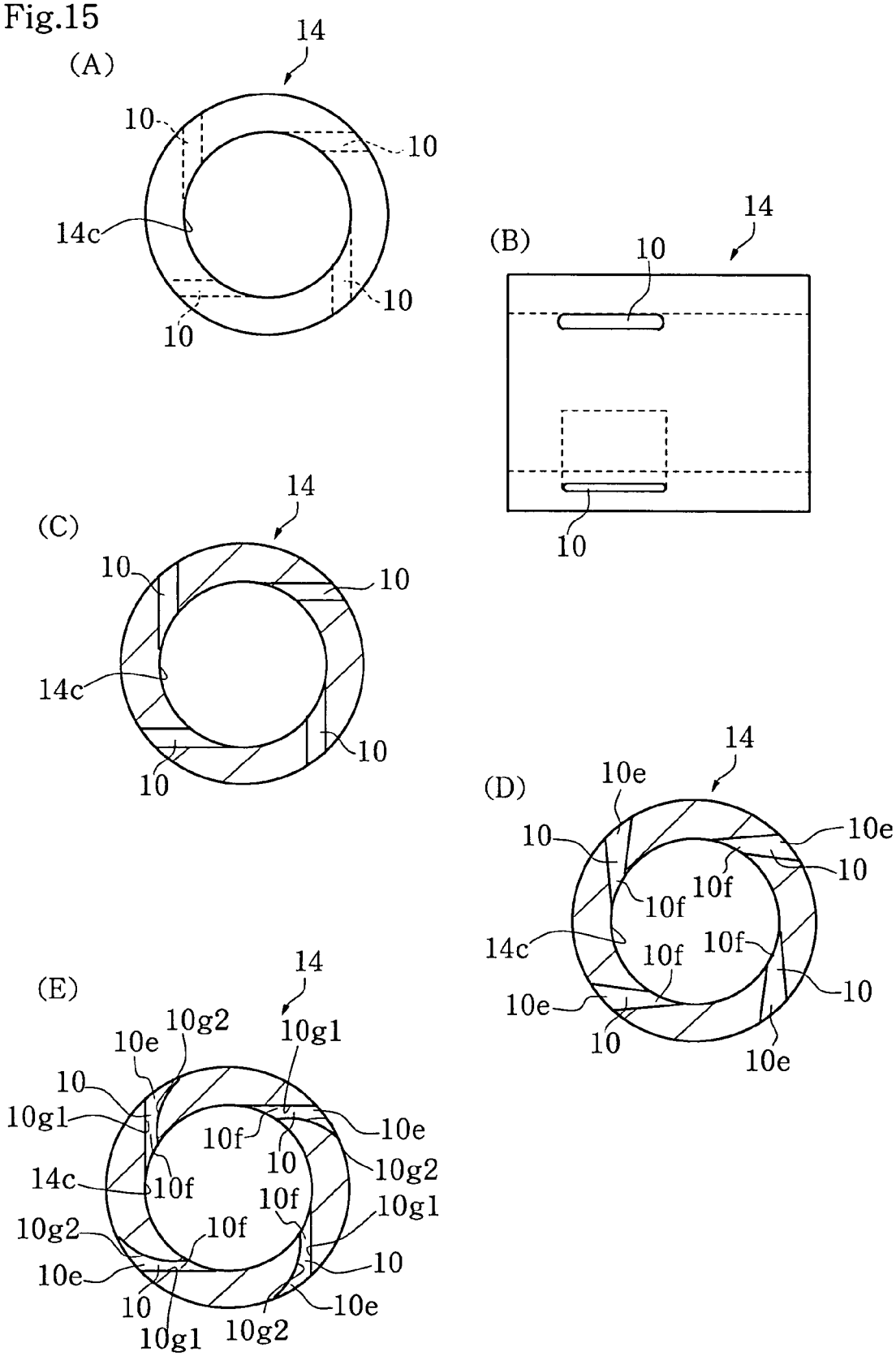
FIGS. 15A to 15E show different embodiments of the orifice ring.

The liquid discharge passageways 10 in the orifice ring 14 in the embodiment in FIG. 15 are disposed at four symmetrical sites when viewed in the direction of the axis of the cyclone portion, and are positioned at an equal distance apart with an angular difference of 90° to one another. Each liquid discharge passageway 10 is formed straight so that the liquid is introduced in the tangential direction of the inner wall 14*c* of the orifice ring 14.

FIG. 15D shows a different embodiment of the liquid discharge passageway 10. The cross-sectional area of the inlet side 10*e* of each of the four liquid discharge passageways 10 is larger than the cross-sectional area of the outlet side 10*f* so that the liquid gradually converges from the inlet side 10*e* to the outlet side 10*f*. This configuration permits the flow rate of the liquid from each of the four liquid discharge passageways 10 to be increased to enable the fine particles to be separated into particles having an accurate particle diameter with an increased accuracy of separation.

FIG. 15E shows a different embodiment of the liquid discharge passageway 10. While the liquid discharge passageway is constructed as in the embodiment in FIG. 15D, the passageway comprises a linear passageway surface 10*g*1 parallel to the tangent perpendicular to the direction of the axis of the cyclone portion, and a curved convex passageway surface 10*g*2. Providing the linear passageway surface 10*g*1 and curved concave passageway 10*g*2 permits the flow rate from the liquid discharge passageway 10 to be increased to enable the fine particles to be separated into particles having an accurate particle diameter with an increased accuracy of separation.

Figure 16:
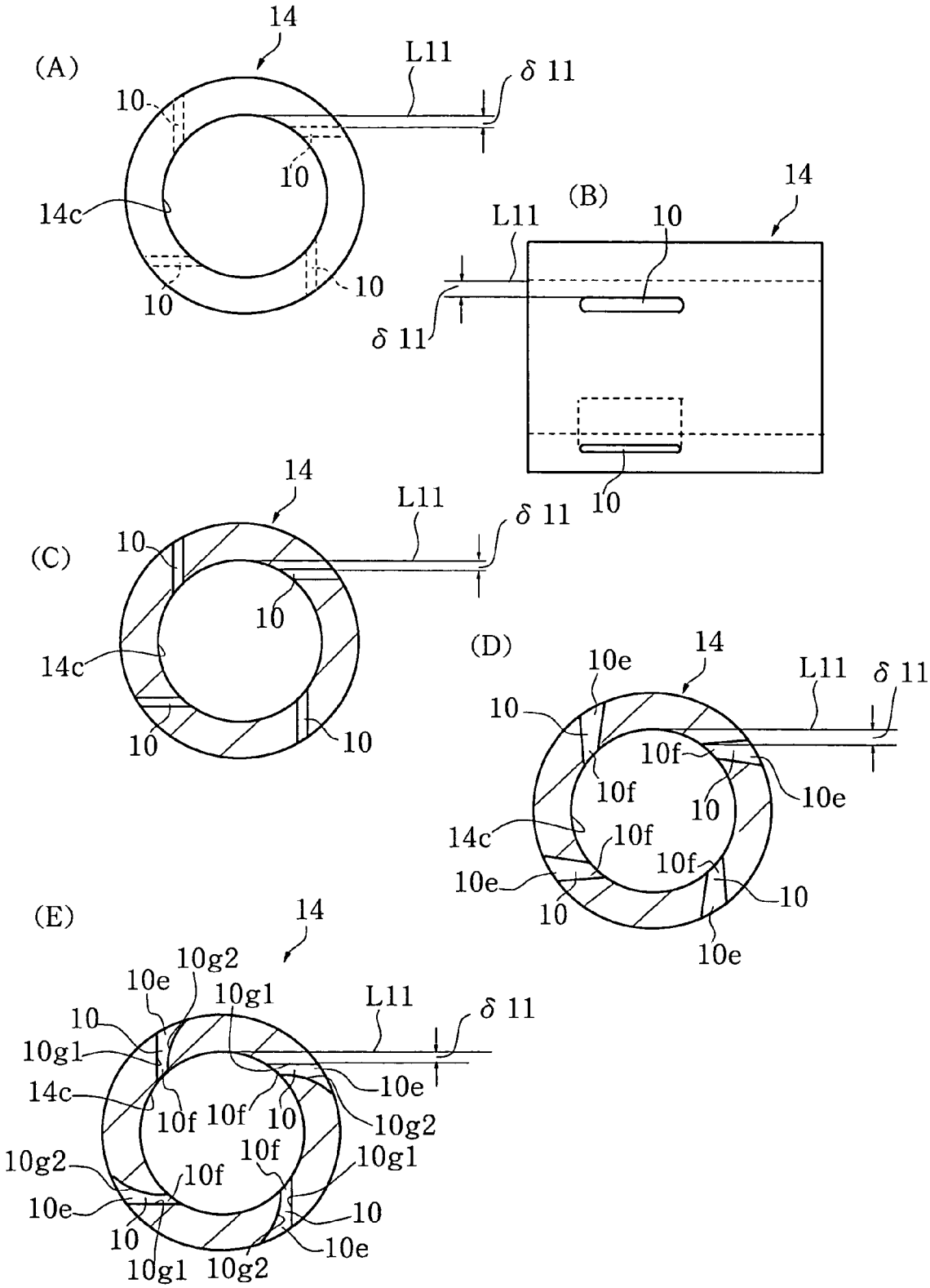
FIGS. 16A to 16E show different embodiments of the orifice ring.

While the orifice ring 14 in the embodiment in FIG. 16 is constructed as in the embodiment in FIG. 15, the liquid discharge passageway is formed by being displaced in the tangential direction L11 of the inner wall 14*c* of the orifice ring 14.

Figure 17:
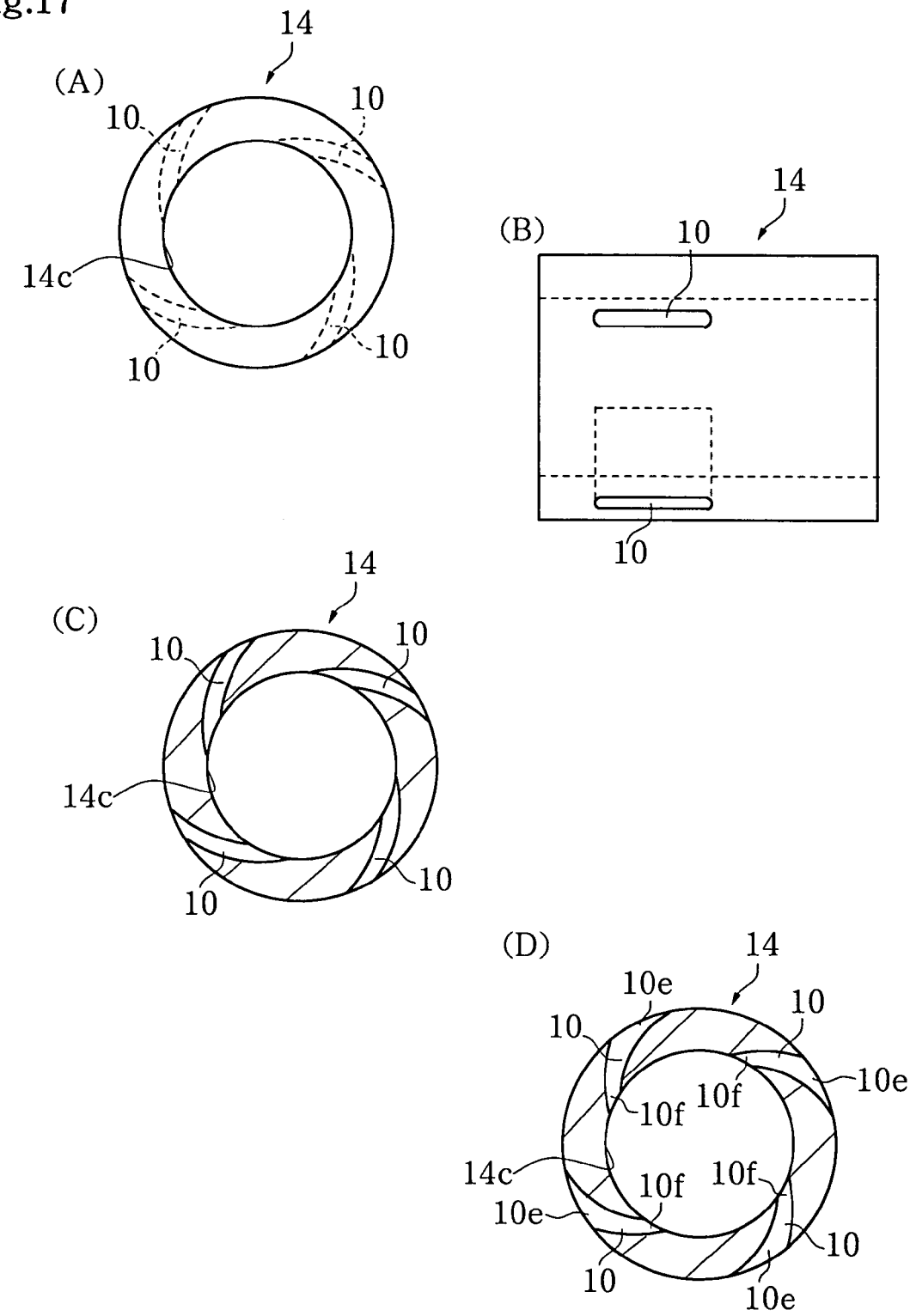
FIGS. 17A to 17D show different embodiments of the orifice ring.

The liquid discharge passageways 10 are disposed at four symmetrical sites when viewed in the axial direction of the cyclone portion in the orifice ring 14 in the embodiment in FIG. 17, and are positioned with an equal distance apart with an angular difference of 90° to one another. The liquid discharge passageway 10 is formed in a curved shape so that the liquid is introduced in the tangential direction of the inner wall 14*c* of the orifice ring 14.

A rectified eddy flow without turbulence can be obtained by disposing the liquid discharge passageways 10 at four symmetrical sites when viewed in the direction of the axis of the cyclone portion in the orifice ring 14. Consequently, the flow rate from the liquid discharge passageway is increased to enable the fine particles to be separated into particles having an accurate particle diameter with an increased accuracy of separation. A rectified eddy flow without turbulence may also be obtained by allowing the liquid to flow in the tangential direction of the inner wall 14*c* of the orifice ring 14 from the liquid discharge passageway 10 along the inner wall of the orifice ring 14. Consequently, the flow rate from the liquid discharge passageway 10 is increased to enable the fine particles to be separated into particles having an accurate particle diameter with an increased accuracy of separation.

As shown in FIG. 17, forming the liquid discharge passageway 10 permits a rectified eddy flow to be obtained along the inner wall 14*c* of the orifice ring 14. Consequently, the flow rate from the liquid discharge passageway 10 is increased to enable the fine particles to be separated into particles having an accurate particle diameter with an increased accuracy of separation.

FIG. 17D shows a different embodiment of the liquid discharge passageway 10. The cross-sectional area of the inlet side 10*e* of the curved liquid discharge passageway 10 is larger than the cross-sectional area of the outlet side 10*f*, and the liquid gradually converges from the inlet side 10*e* to the outlet side 10*f*. Consequently, the flow rate from the liquid discharge passageway 10 is increased to enable the fine particles to be separated into particles having an accurate particle diameter with an increased accuracy of separation.

Figure 18:
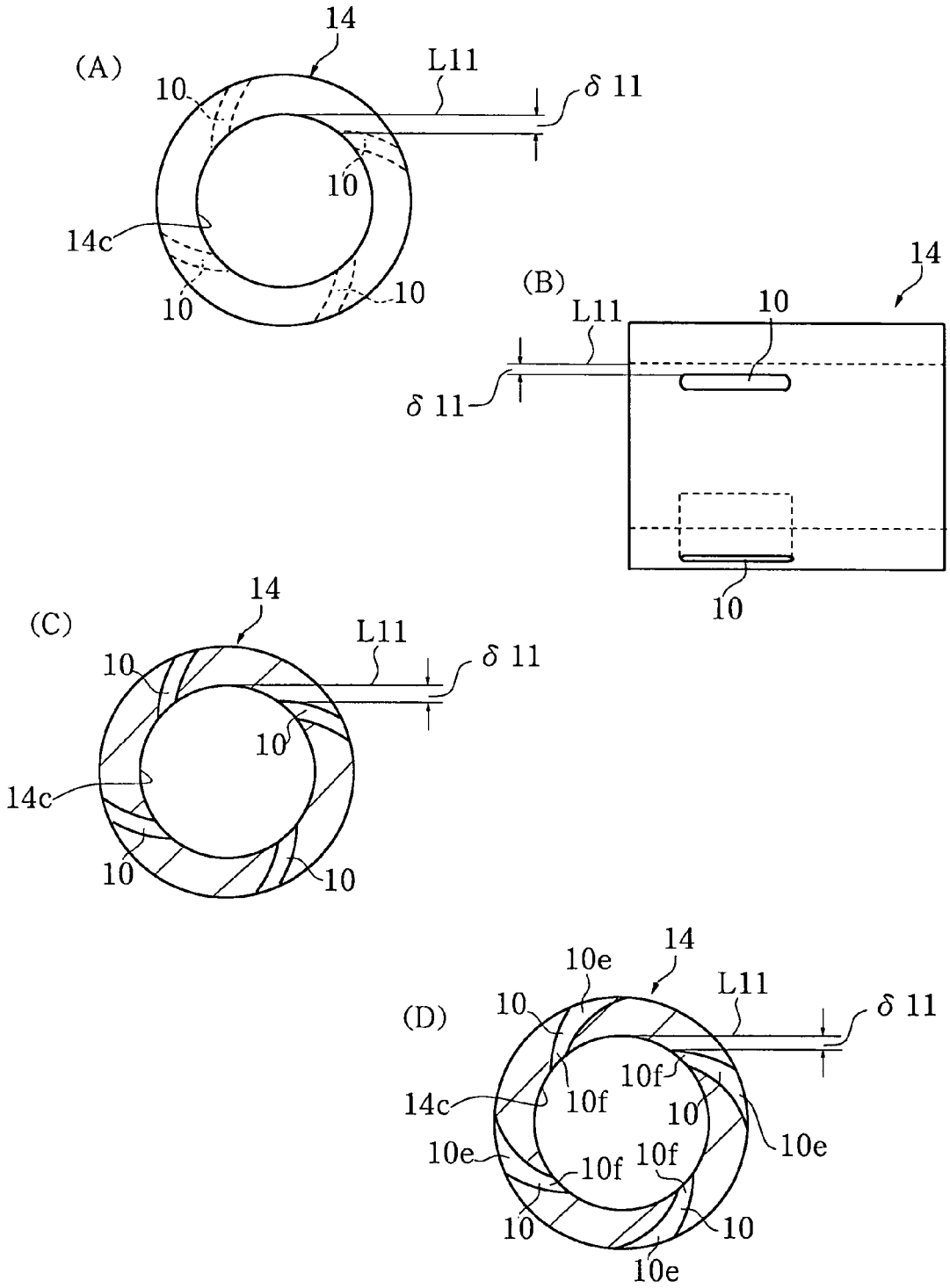
FIGS. 18A to 18D show different embodiments of the orifice ring.

While the orifice ring 14 in the embodiment in FIG. 18 is constructed as in the embodiment in FIG. 17, the liquid discharge passageway 10 is inwardly formed in the tangential direction L11 of the inner wall 14*c* of the orifice ring 14.

Figure 19:
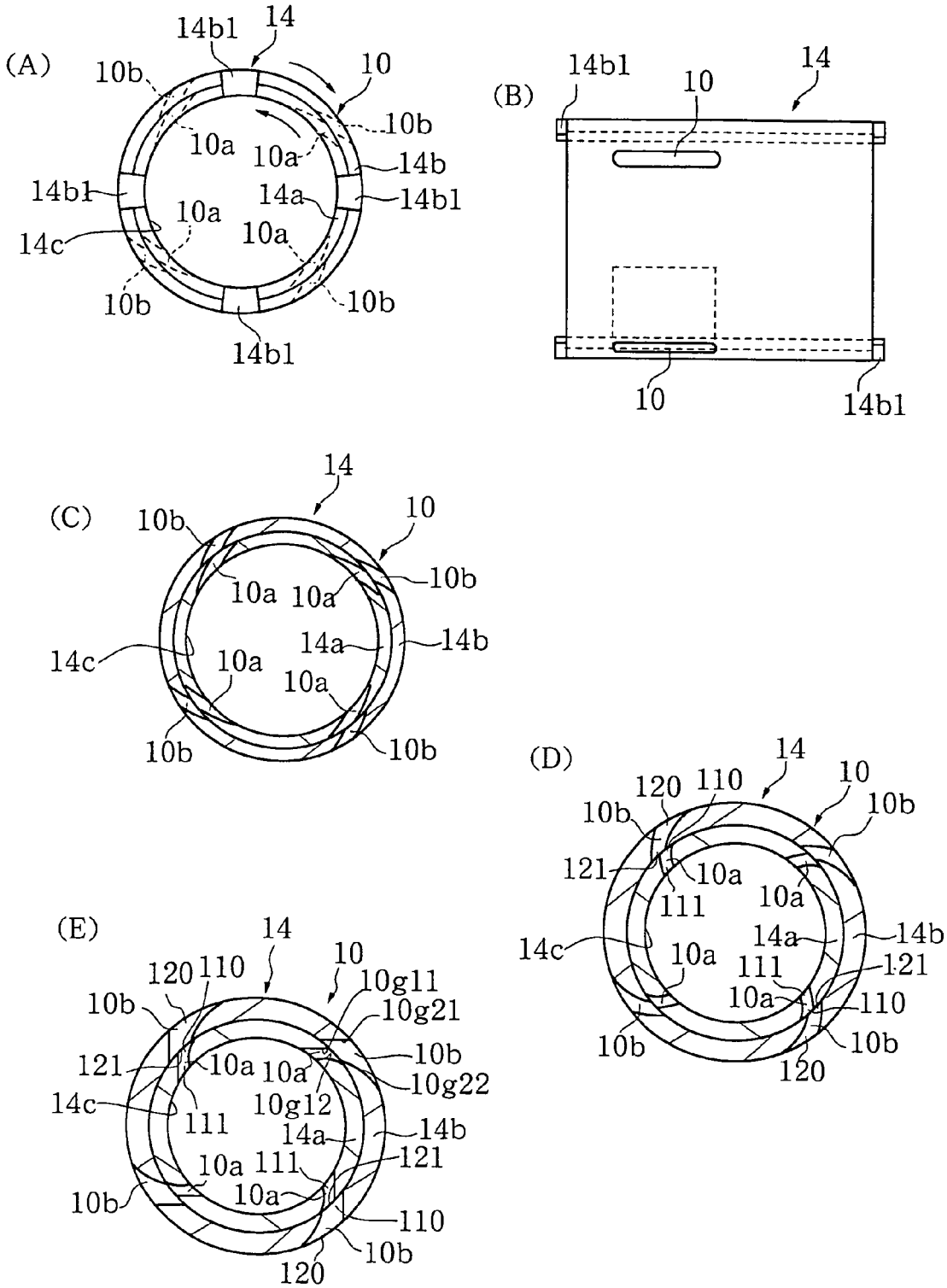
FIGS. 19A to 19E show different embodiments of the orifice ring.

The orifice ring 14 in the embodiment in FIG. 19 comprises an inner ring 14*a* having outlet side liquid discharge passageways 10*a* and an outer ring 14*b* having inlet side liquid discharge passageways 10*b*. Both ends of the inner ring 14*a* of the inner ring 1*a* and outer ring 14*b* are supported by holding pieces 14*b*1, and the inner ring 14*a* and outer ring 14*b* are slidable against one another in the direction of the circumference.

The aperture of the liquid discharge passageway 10 changes depending on the degree of overlap between the outlet side liquid discharge passageways 10*a* and inlet side liquid discharge passageways 10*b* by allowing the inner ring 14*a* and outer ring 14*b* to slide against one another in the circumferential direction. Consequently, the liquid flow-in rate from the liquid discharge passageway 10 becomes variable to make it possible to change the particle diameter of the separated particles.

FIG. 19D shows another embodiment of the liquid discharge passageway 10. The cross-sectional area of the inlet side 110 of the curved outlet side liquid discharge passageway 10*a* is larger than the cross-sectional area of the outlet side 111, and the cross-sectional area of the inlet side 120 of the inlet side liquid discharge passageway 10*b* is larger than the cross-sectional area of the outlet side 121. The liquid gradually converges from the inlet side to the outlet side. Consequently, the flow rate of the liquid from the liquid discharge passageway 10 is increased to enable the fine particles to be separated into particles having an accurate particle diameter with an increased accuracy of separation.

FIG. 19E shows a different embodiment of the liquid discharge passageway 10. While this embodiment is the same as that in FIG. 19D, the liquid discharge passageway 10 comprises linear passageway surfaces 10*g*11 and 10*g*12 parallel to the tangent in the cross-section perpendicular to the axis of the cyclone part, and curved concave passageway surfaces 10*g*21 and 10*g*22 facing the linear passageway surfaces 10*g*11 and 10*g*12. The flow rate of the liquid from the liquid discharge passageway 10 increases by providing the linear passageway surfaces 10*g*11 and 10*g*12 and curved passageway surfaces 10*g*21 and 10*g*22 to enable the fine particles to be separated into particles having an accurate particle diameter with an increased accuracy of separation.

The position and number of the liquid discharge passageways 10 are not particularly restricted. A structure for permitting the flow rate of the liquid from the liquid pressurizing chamber 12 to the introduction chamber 19 to increase is preferable, and this structure is not particularly restricted.

Figure 20:
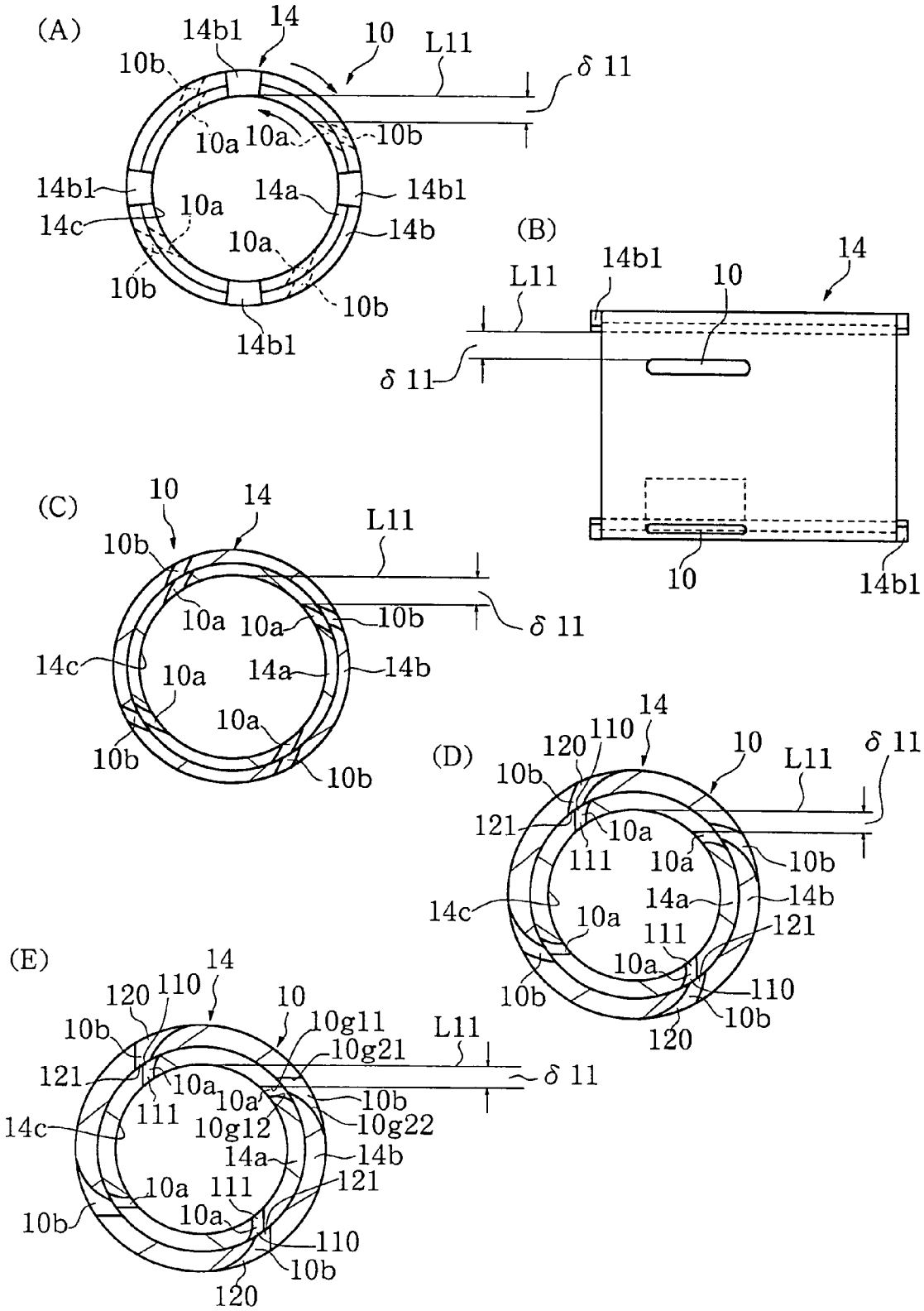
FIGS. 20A to 20E show different embodiments of the orifice ring.

While the orifice ring 14 in the embodiment in FIG. 20 has the same construction as that in FIG. 19, the liquid flow passageway is formed by being inwardly displaced in the tangential direction L11 of the inner wall 14*c* of the orifice ring 14.

EXAMPLE

Comparative Example

Figure 21:
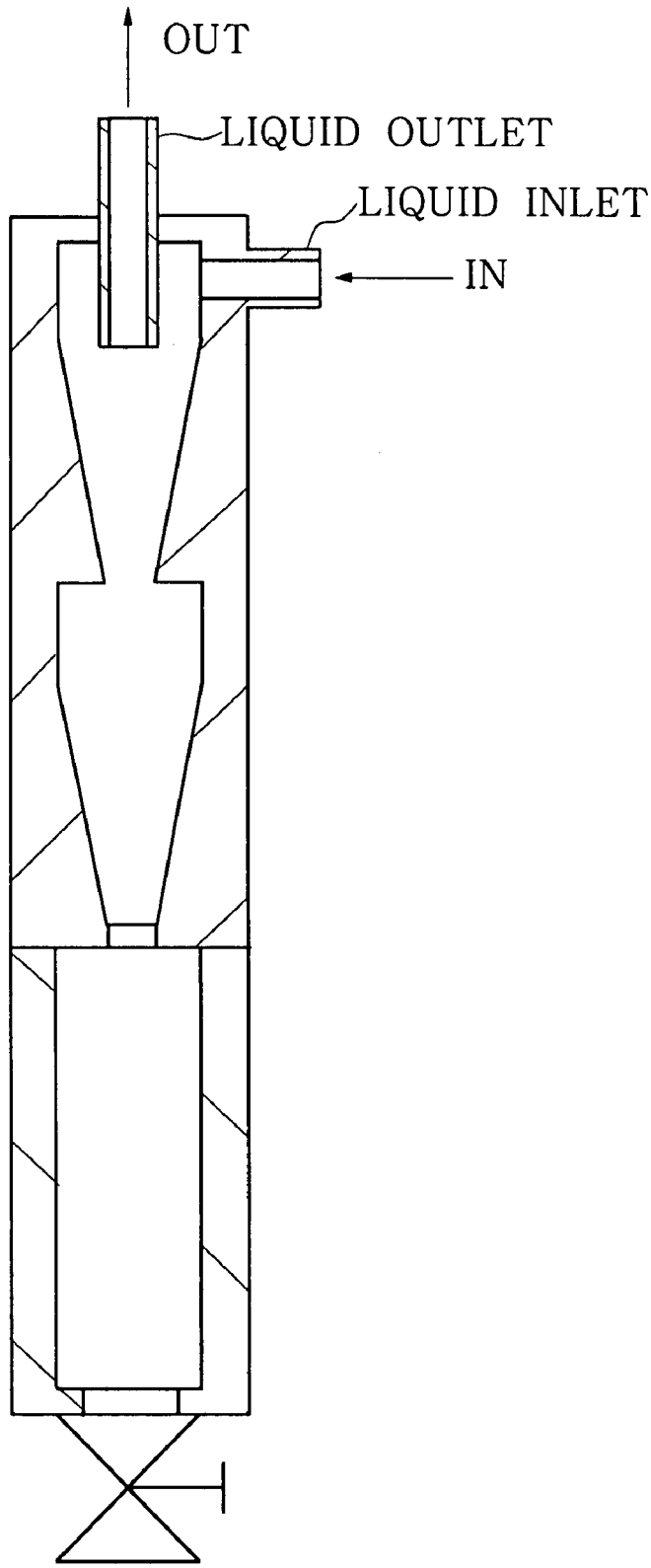
Fig.21 (PRIOR ART)
FIG. 21 is a cross-section of the cyclone separator in the comparative example.
Figure 22:
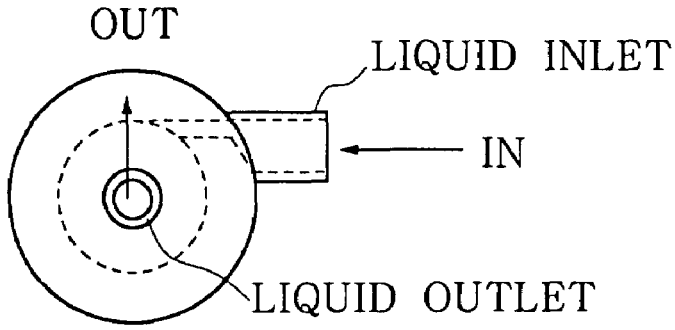
Fig.22 (PRIOR ART)
FIG. 22 is a plan view of the cyclone separator in the comparative example.

Separation treatments were performed using the cyclone separator having multi-hole inlets shown in FIGS. 1 to 3, and the cyclone separator having single-hole inlets shown in FIGS. 21 and 22 as a comparative example. A dispersion solution containing silica particles in ion-exchange water was used as the sample. Separation efficiencies were measured by changing the flow rate of the sample solution containing the powder.

The cyclone separator having the single-hole inlets shown in FIGS. 21 and 22 as the comparative example comprises a liquid outlet at the axis of the cyclone portion, and a liquid inlet at a position displaced from the axis. An eddy flow is generated by feeding the liquid containing the fine substance from the liquid inlet at a given flow rate, the fine substance is transferred to the outer circumferential side by applying a centrifugal force, and the fine substance-free liquid is discharged from the liquid outlet. The separated fine substance is precipitated by decelerating the eddy flow.

Figure 23:
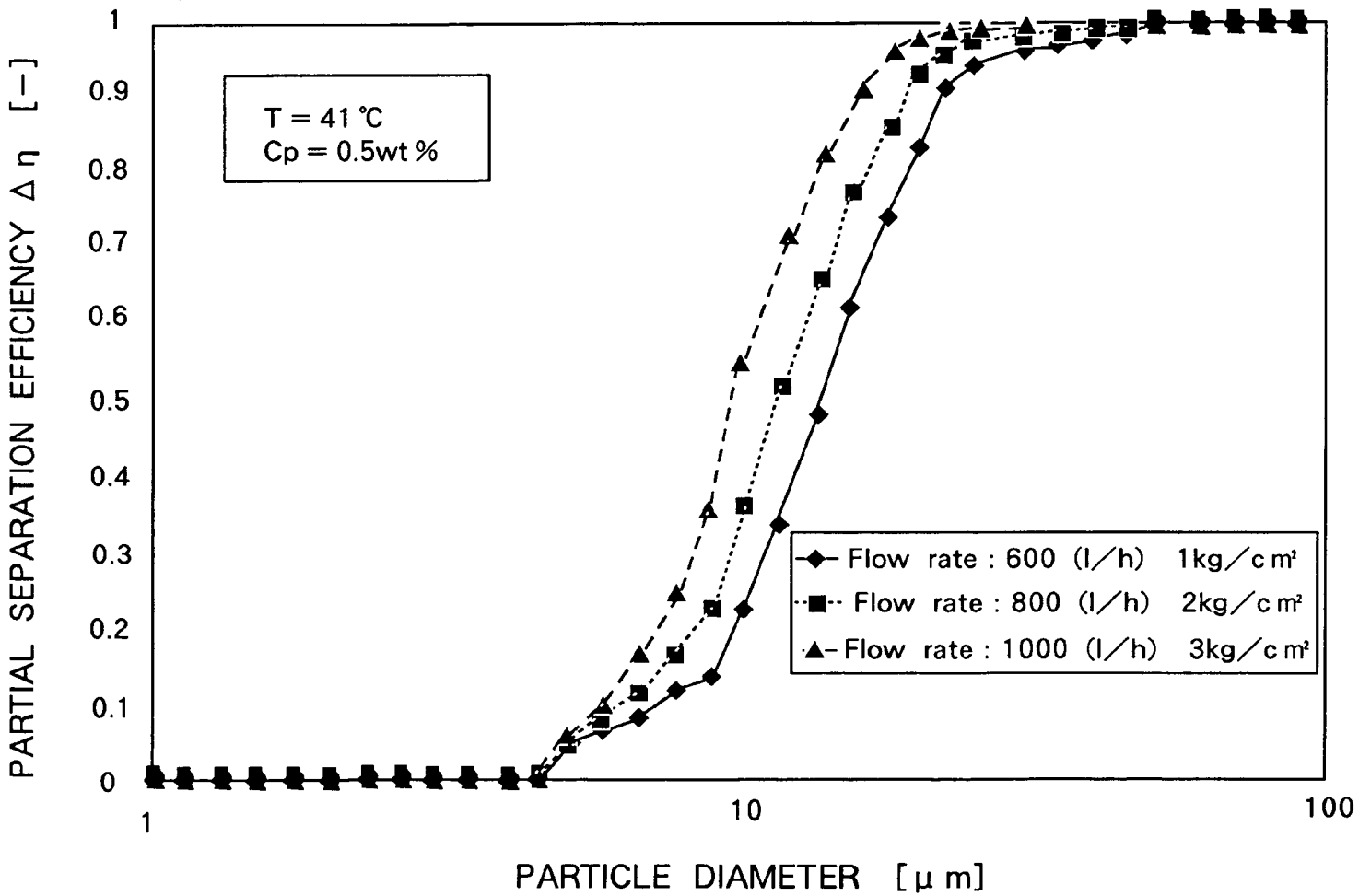
Fig.23 (PRIOR ART)
FIG. 23 shows the separation efficiency in the comparative example.

The results are shown in FIG. 23. The measuring conditions in FIG. 23 are as follows:

Sample powder: silica particles

Dispersant: ion-exchange water

Temperature (T) of dispersant: 41° C.

Flow rate (Q) of dispersant: 600 liter/h, 800 liter/h, 1000 liter/h

Concentration (Cp) in dispersant: 0.5 weight %

The result in FIG. 23 shows that only the particles with a particle diameter of about 10 μm could be separated even by changing the flow rate of the dispersant.

Example

Figure 24:
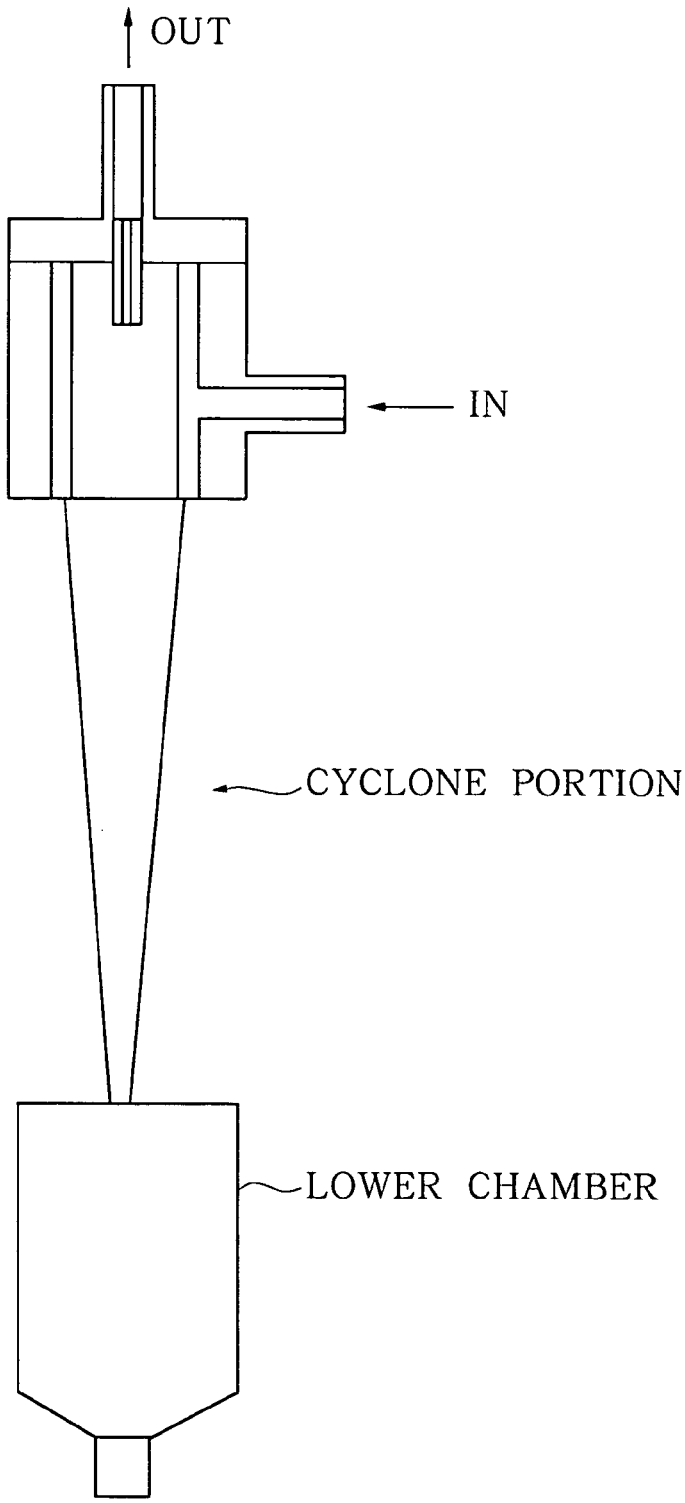
FIG. 24 shows a cross-section of the cyclone separator in the example.
Figure 25:
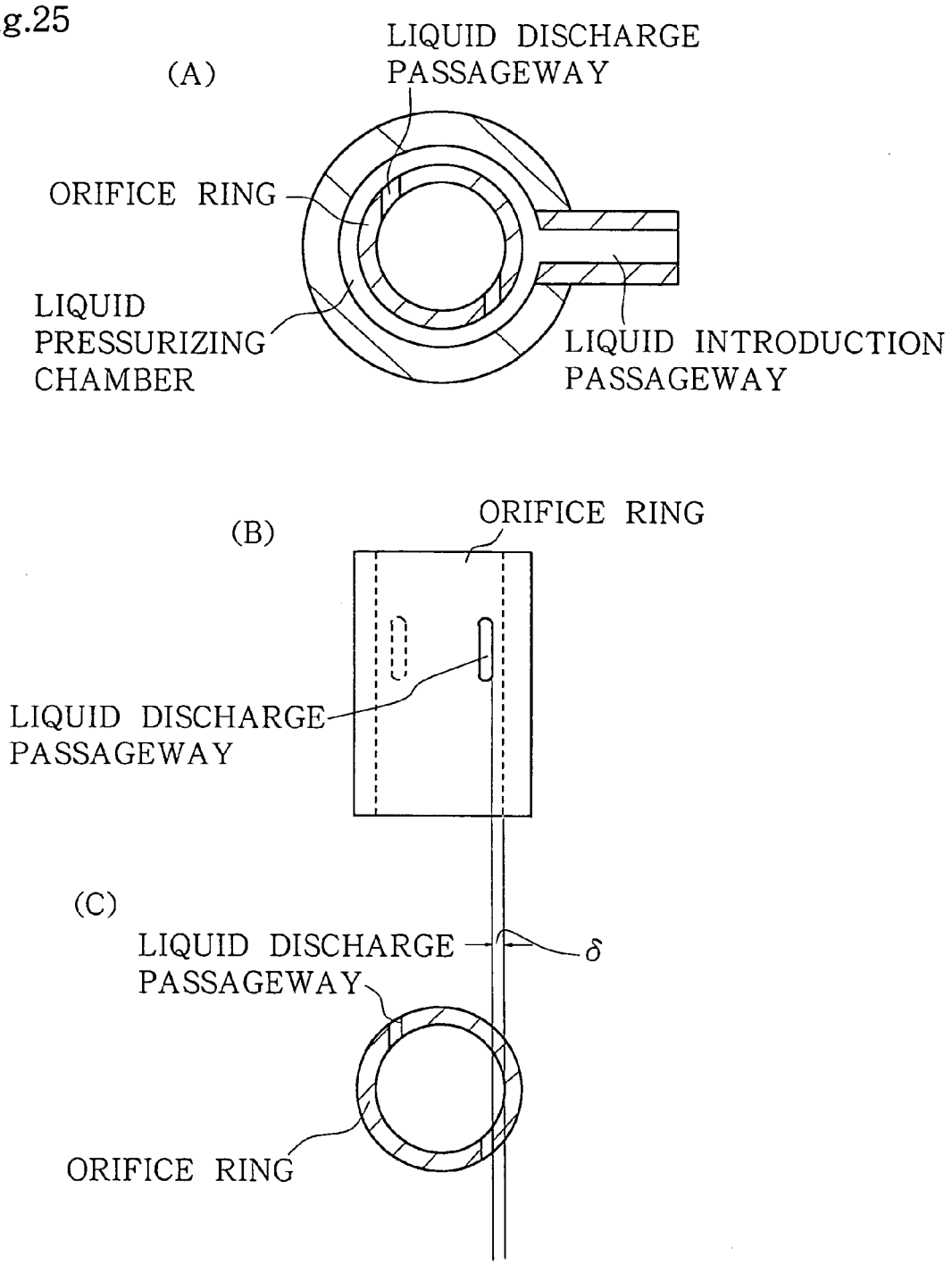
FIGS. 25A to 25C show the orifice ring of the cyclone separator in the example.

The separation treatment was performed using the cyclone separator in the example shown in FIGS. 24 and 25. A dispersion solution containing silica particles in ion-exchange water was used as the sample.

The cyclone separator used in this example comprises: a cyclone portion for generating an eddy flow at a given flow rate by feeding a liquid containing a fine substance from a liquid discharge passageway, transferring the fine substance to the outer side by applying a centrifugal force to discharge a fine substance-free liquid through the liquid flow-out passageway, and precipitating the separated fine substance by decelerating the eddy flow, orifice rings having two liquid discharge passageways, pressurizing chambers provided around the two liquid discharge passageways and communicating therewith, and a liquid introduction passageway for introducing the liquid containing the fine substance into the liquid pressurizing chamber. The liquid discharge passageway is formed by being inwardly displaced in the tangential direction of the inner wall of the orifice ring.

Figure 26:
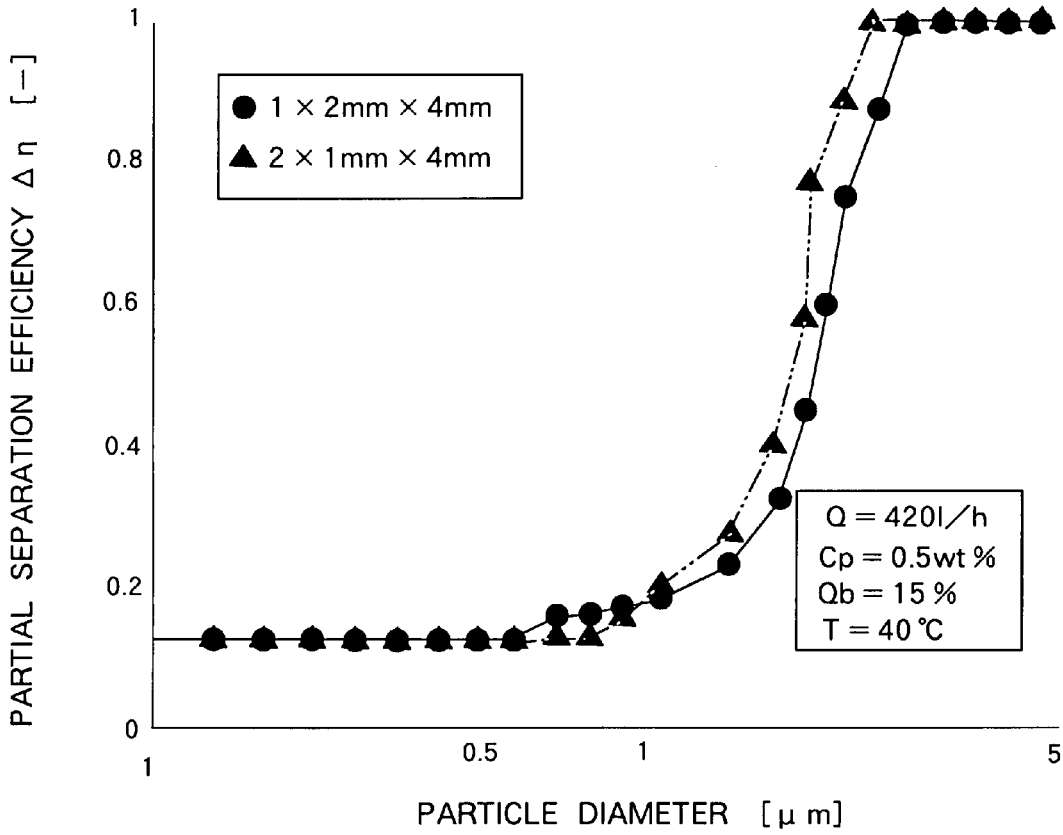
FIG. 26 shows the separation efficiency in the example.
Figure 27:
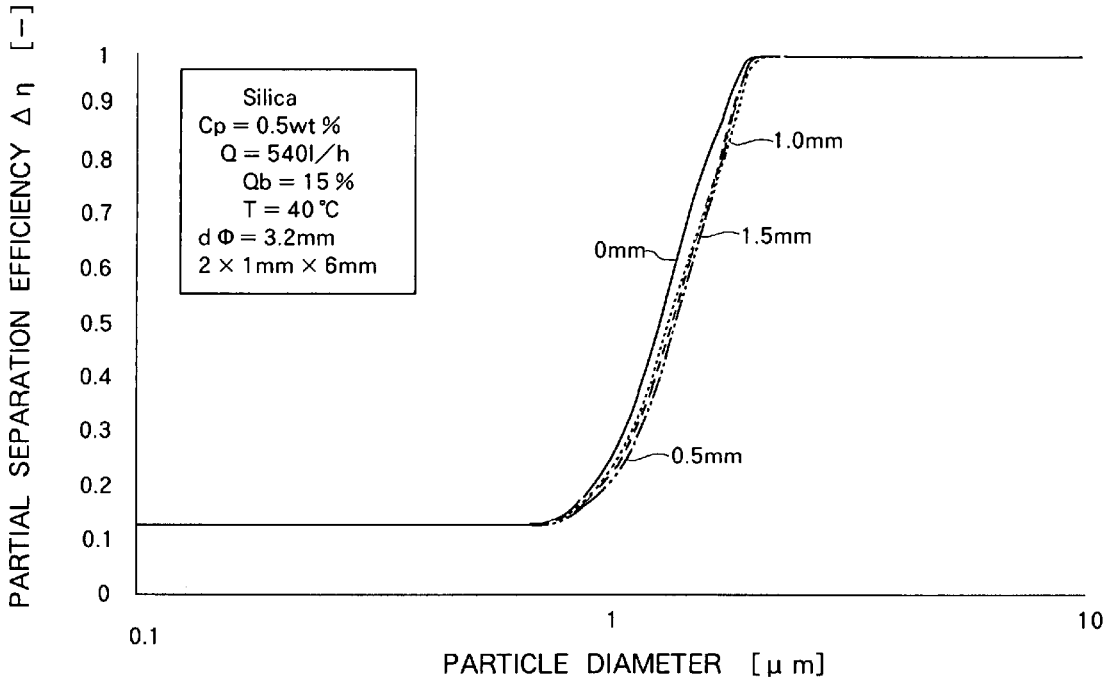
FIG. 27 shows the separation efficiency in the example.

A powder sample was separated using this cyclone separator. The results are shown in FIGS. 26 and 27. The measuring conditions are as follows:

Sample powder: silica particles

Dispersant: ion-exchange water

Temperature (T) of dispersant: 40° C.

Flow rate (Q) of dispersant: 420 liter/h Concentration (Cp) in dispersant: 0.5 weight %

Blow-down flow rate ratio (the proportion of liquid that flows into the lower chamber): 15%

The relationships between the particle diameter of the separated particles and separation efficiency under the conditions above are shown by solid circles and solid triangles, wherein a cyclone separator having one liquid discharge passageway with a width of 2 mm and a length of 4 mm, and a cyclone separator having one liquid discharge passageway with a width of 1 mm and a length of 4 mm were used for obtaining the data shown by the solid circles and solid triangles, respectively. It was shown that the particles could be classified into finer particles by forming plural liquid discharge passageways when the cross-sectional area of the liquid discharge passageway was the same.

The measuring conditions of the data shown in FIG. 27 are as follows:

Sample powder: silica particles

Dispersant: ion-exchange water

Temperature (T) of dispersant: 40° C.

Flow rate (Q) of dispersant: 540 liter/h

Concentration (Cp) in dispersant: 0.5 weight %

Blow-down flow rate ratio (the proportion of liquid that flows into the lower chamber): 15%

Diameter (dϕ) of liquid flow-out passageway: 3.2 mm

Liquid discharge passageway: two, width 1 mm, length 6 mm

The powder sample was separated under the measuring conditions above. The liquid discharge passageway was displaced 0, 0.5, 1.0 and 1.5 mm inside in the tangential direction of the inner wall. Separation was not performed when the displacement was 2.0 mm since a desired flow rate could not be obtained.

While the diameter of the separated particles was slightly increased by changing the displacement from 0.5 mm to 1.5 mm by taking the displacement of 0 mm in the tangential direction of the inner wall of the liquid discharge passageway as a standard, the slope of the partial separation efficiency curve was increased. The separation profile becomes an ideal classification. Turbulent flow becomes large near the wall when the displacement δ is 0 mm. However, when the liquid is supplied from a position slightly remote from the wall, the appearance of the turbulent flow became small and the separation profile was an almost ideal separation. It was shown that the separation productivity and separation performance could be improved by decreasing the degree of turbulence of the eddy flow, when the liquid discharge passageway is displaced 0.5 to 1.5 mm inwardly in the tangential direction of the inner wall of the liquid discharge passageway.

The results in the example shown in FIGS. 26 and 27 show that particles with a particle diameter of about 1 μm could be separated. This result shows that the separation performance could be improved as compared with the results of the comparative example shown in FIG. 23 in which the diameter of the separated particles was about 10 μm.

What is claimed is:

1. A cyclone separator for separating a fine substance from a liquid containing the fine substance, the cyclone separator comprising:

an introduction passageway for introducing the liquid containing the fine substance;

a liquid pressurizing chamber containing an orifice ring for receiving the liquid containing the fine substance from the introduction passageway and discharging the liquid containing the fine substance through discharge passageways provided in the orifice ring at plural sites thereof in an eddy flow, the orifice ring comprising an inner ring having an outlet liquid discharge passageway and an outer ring having an inlet liquid passageway, the area of the inlet liquid passageway being varied through relative sliding movement between the inner ring and the outer ring in a circumferential direction;

a cyclone body for receiving the liquid containing the fine substance in an eddy flow, separating the fine substance from the liquid containing the fine substance by transferring the fine substance to an outer circumferential side thereof by centrifugal force, discharging the liquid separated from the fine substance and precipitating the separated fine substance; and a liquid flow-out passageway for receiving the separated liquid discharged from the cyclone body and discharging the separated liquid from the cyclone separator.

2. The cyclone separator according to claim 1, wherein the discharge passageways are disposed at symmetrical positions when viewed from a direction along the axis of the cyclone portion.

3. The cyclone separator according to claim 2, wherein the discharge passageways are disposed with an equal distance apart from one another.

4. The cyclone separator according to claim 2, wherein the discharge passageways are formed into a curved shape.

5. The cyclone separator according to claim 1, wherein the discharge passageways permit the liquid to flow in a tangential direction of an inner wall of the orifice ring.

6. The cyclone separator according to claim 1, wherein the discharge passageways are formed so as to be displaced in the tangential direction toward the inside of an inner wall of the orifice ring.

7. The cyclone separator according to claim 6, wherein the discharge passageways are displaced 0.5 to 1.5 mm inside in the tangential direction of the inner wall of the orifice ring.

8. The cyclone separator according to claim 6, wherein the discharge passageways have a linear passageway surface parallel to the tangent of an inner wall of the orifice ring and a convex passageway surface at a linear passage surface side.

9. The cyclone separator according to claim 1, wherein the discharge passageways have a larger cross-sectional area at an inlet side than the cross-sectional area at an outlet side.

10. The cyclone separator according to claim 1, wherein the orifice ring is exchangeable with another orifice ring having a different discharge passageway.

11. The cyclone separator according to claim 1 comprising:

a liquid flow-in part having the liquid discharge passageway formed therein to upwardly open at an upper part thereof and a cover containing the liquid flow-out passageway and closing the opening of the liquid flow-in part, the orifice ring being supported between the liquid flow-in part and the cover in an attachable and detachable manner.

12. A cyclone separator for separating a fine substance from a liquid containing the fine substance, the cyclone separator comprising:

an introduction passageway for introducing the liquid containing the fine substance;

a liquid pressurizing chamber containing a plurality of orifice rings for receiving the liquid containing the fine substance from the introduction passageway and discharging the liquid containing the fine substance through discharge passageways provided in each of the orifice rings at plural sites thereof in an eddy flow, each orifice ring comprising an inner ring having an outlet liquid discharge passageway and an outer ring having an inlet liquid passageway, the area of the inlet liquid passageway being varied through relative sliding movement between the inner ring and the outer ring in a circumferential direction;

a plurality of cyclone bodies, each cyclone body being associated with a respective orifice ring and receiving the liquid containing the fine substance in an eddy flow from the respective orifice ring, separating the fine substance from the liquid containing the fine substance by transferring the fine substance to an outer circumferential side thereof by centrifugal force, discharging the liquid separated from the fine substance and precipitating the separated fine substance; and a liquid flow-out passageway for receiving the separated liquid discharged from the plural cyclone bodies and discharging the separated liquid from the cyclone separator.

13. The cyclone separator according to claim 12, wherein the external discharge part is not disposed on the axial of the liquid introduction passageway.

14. The cyclone separator according to claim 12, wherein the external discharge part is disposed on the axial line of the liquid introduction passageway.

* * * * *